US010061216B2

(12) United States Patent
Zenitani et al.

(10) Patent No.: US 10,061,216 B2
(45) Date of Patent: Aug. 28, 2018

(54) ELECTROSTATIC IMAGE DEVELOPER AND TONER, ELECTROSTATIC IMAGE DEVELOPER AND TONER CARTRIDGE

(71) Applicant: FUJI XEROX CO., LTD., Tokyo (JP)

(72) Inventors: Yuka Zenitani, Minamiashigara (JP); Hiroyoshi Okuno, Minamiashigara (JP); Satoshi Inoue, Minamiashigara (JP); Yoshifumi Iida, Minamiashigara (JP); Tomohito Nakajima, Minamiashigara (JP); Yoshifumi Eri, Minamiashigara (JP); Takeshi Iwanaga, Minamiashigara (JP); Sakae Takeuchi, Minamiashigara (JP); Shunsuke Nozaki, Tokyo (JP); Yasuo Kadokura, Minamiashigara (JP); Yasuhisa Morooka, Minamiashigara (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/225,526

(22) Filed: Aug. 1, 2016

(65) Prior Publication Data

US 2017/0227861 A1 Aug. 10, 2017

(30) Foreign Application Priority Data

Feb. 10, 2016 (JP) ..... 2016-024131
Feb. 10, 2016 (JP) ..... 2016-024134

(51) Int. Cl.
*G03G 9/08* (2006.01)
*G03G 15/08* (2006.01)
(Continued)

(52) U.S. Cl.
CPC ..... *G03G 9/0819* (2013.01); *G03G 9/08755* (2013.01); *G03G 9/1132* (2013.01);
(Continued)

(58) Field of Classification Search
CPC ..... G03G 9/0819; G03G 15/0865; G03G 9/1132; G03G 9/1139; G03G 9/08755
See application file for complete search history.

(56) References Cited

U.S. PATENT DOCUMENTS 5,707,769 A * 1/1998 Hagi ..... G03G 9/0908 430/108.2
6,287,739 B1 * 9/2001 Kawakami ..... G03G 9/0819 399/222
(Continued)

FOREIGN PATENT DOCUMENTS

JP H11-338182 A 12/1999
JP 2003-167375 A 6/2003
(Continued)

OTHER PUBLICATIONS

Dec. 5, 2017 Office Action in Japanese Application No. 2016-024134.
(Continued)

*Primary Examiner* — Thorl Chea
(74) *Attorney, Agent, or Firm* — Oliff PLC

(57) ABSTRACT

An electrostatic image developing toner contains: toner particles, first silica particles having an average equivalent circle diameter of 10 nm to 120 nm and second silica particles having a compressive agglomeration degree of 60% to 95%, a particle compression ratio of 0.20 to 0.40 and an average equivalent circle diameter being greater than the average equivalent circle diameter of the first silica particles.

18 Claims, 2 Drawing Sheets

(51) Int. Cl.
*G03G 9/087* (2006.01)
*G03G 9/113* (2006.01)

(52) U.S. Cl.
CPC ..... *G03G 9/1139* (2013.01); *G03G 15/08* (2013.01); *G03G 15/0865* (2013.01); *G03G 2215/0132* (2013.01)

(56) References Cited

U.S. PATENT DOCUMENTS

| | | | |
|---|---|---|---|
| 7,252,915 | B2 | 8/2007 | Lee et al. |
| 2005/0019686 | A1 | 1/2005 | Lee et al. |
| 2008/0268362 | A1 | 10/2008 | Kudo |

FOREIGN PATENT DOCUMENTS

| | | | |
|---|---|---|---|
| JP | 2005-516241 | A | 6/2005 |
| JP | 2006-072093 | A | 3/2006 |
| JP | 2006-259169 | A | 9/2006 |
| JP | 2007-279400 | A | 10/2007 |
| JP | 2008-145652 | A | 6/2008 |
| JP | 2008-273757 | A | 11/2008 |
| JP | 2012-128176 | A | 7/2012 |
| JP | 2013-122499 | A | 6/2013 |

OTHER PUBLICATIONS

Aug. 1, 2017 Office Action issued in Japanese Application No. 2016-024134.

* cited by examiner

ELECTROSTATIC IMAGE DEVELOPER AND TONER, ELECTROSTATIC IMAGE DEVELOPER AND TONER CARTRIDGE

CROSS-REFERENCE TO RELATED APPLICATIONS

This application is based on and claims priority under 35 USC 119 from Japanese Patent Application No. 2016-024131 filed on Feb. 10, 2016 and Japanese Patent Application No. 2016-024134 filed on Feb. 10, 2016.

BACKGROUND

1. Technical Field

The present invention relates to an electrostatic image developing toner, an electrostatic image developer, a toner cartridge, a process cartridge, an image forming apparatus and an image forming method.

2. Related Art

Methods of visualizing image information via electrostatic images formed according to electrophotography or the like are currently utilized in various fields. In the electrophotography, image information is formed as electrostatic images on the surface of an image holding material (a photoreceptor) via a charging process and a subsequent exposing process, the electrostatic images are converted to toner images on the image holding material's surface by development with a developer that contains toner, the toner images are subjected to a transfer process wherein they are transferred to a recording material such as a sheet of paper, and further the transferred images are subjected to a fixing process wherein they are fixed to the recording material's surface, and thus the image information is visualized in the form of images.

SUMMARY

According to an aspect of the invention, there is provided an electrostatic image developing toner, comprising: toner particles, first silica particles having an average equivalent circle diameter of 10 nm to 120 nm and second silica particles having a compressive agglomeration degree of 60% to 95%, a particle compression ratio of 0.20 to 0.40 and an average equivalent circle diameter greater than the average equivalent circle diameter of the first silica particles.

DETAILED DESCRIPTION

Figure 1:
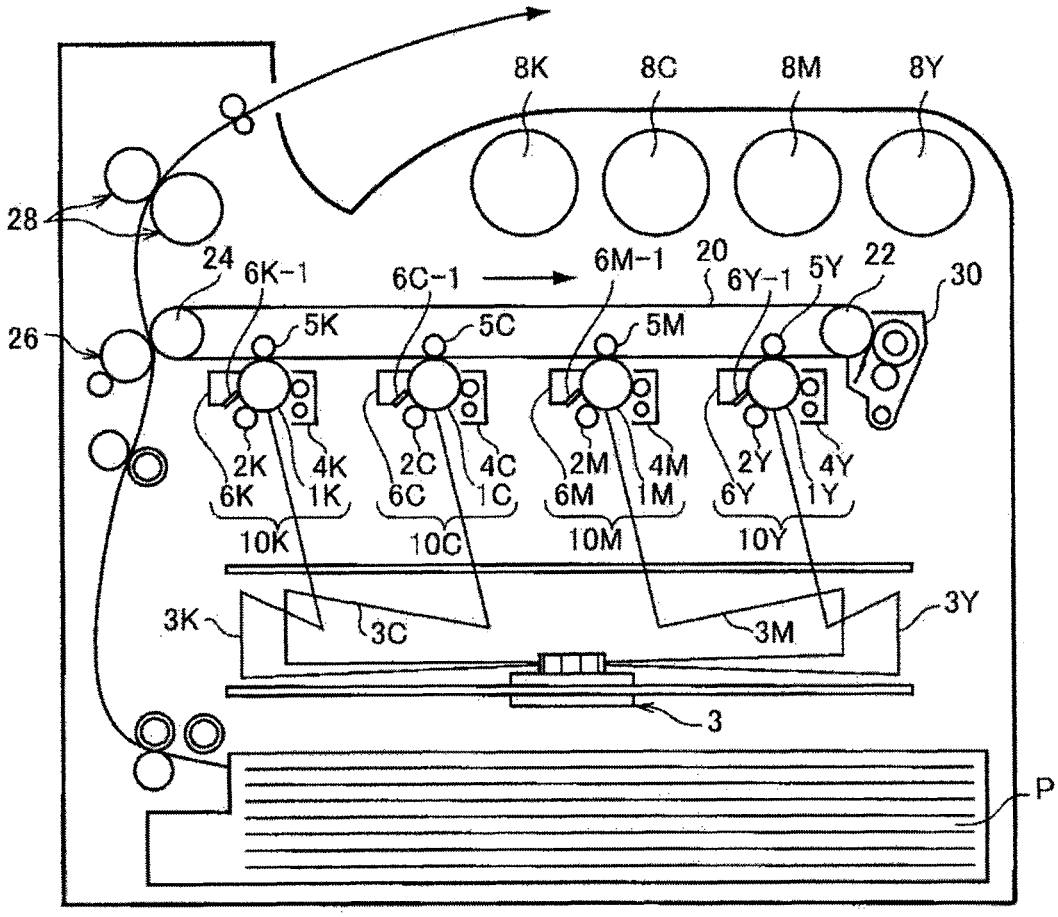
FIG. 1 is a schematic configuration diagram showing an example of an image forming apparatus relating to an exemplary embodiment of the invention

Exemplary embodiments of the invention are illustrated below.

<Electrostatic Image Developing Toner>

The electrostatic image developing toner relating to an exemplary embodiment of the invention (hereafter referred to as the toner) is a toner that contains toner particles and external additives.

And the external additives include first silica particles having an average equivalent circle diameter of 10 nm to 120 nm (hereafter referred to as small-sized silica particles also) and second silica particles (hereafter referred to as specific silica particles also) having a compressive agglomeration degree of 60% to 95%, a particle compression ratio of 0.20 to 0.40 and an average equivalent circle diameter greater than the average equivalent circle diameter of the first silica particles.

Herein, the use of traditional toner containing toner particles to which the small-sized silica particle are added externally for the purpose of enhancing flowability may cause a phenomenon that the amount of electrostatic charges on the toner particles becomes excessive (hereafter referred to as charge-up also).

More specifically, when the toner containing toner particles to which small-sized silica particles are added externally are agitated together with a carrier in a developing unit, the small-sized silica particles are brought into direct contact with the carrier, and therein friction develops to result in excessive electrification. As a reason for the excessive electrification, it is supposed that, even when the small-sized particles are added in a small amount, they can have high coverage on the surfaces of toner particles because of their small sizes; as a result, areas of their contact with the carrier become large.

And toner particles to which a large number of small-sized silica particles in an excessively electrified state are added externally are brought into an excessively electrified state (charged-up state) as a whole.

On the other hand, the charge-up phenomenon may be inhibited from occurring by using as external additives small-sized silica particles and large-sized silica particles in combination.

More specifically, large-sized silica particles produce cushioning effect (hereafter referred to as spacer effect) by external addition thereof, and contact of the large-sized silica particles with the carrier makes it difficult to bring the small-sized silica particles into direct contact with the carrier. Thus the proportion of small-sized silica particles excessively electrified through the friction against the carrier is reduced. In contrast to this, the large-sized silica particles are small in area of contact with the carrier even when they are brought into direct contact with the carrier, and hence they are difficult to electrify excessively as compared with the small-sized silica particles. Accordingly, the combined use of small-sized silica particles and large-sized silica particles allows reduction in total electrification amount of external additives-attached toner particles, thereby inhibiting the charge-up phenomenon.

However, in the case of using traditional large-sized silica particles, it is difficult to carry out external addition of traditional large-sized silica particles to the surfaces of toner particles in a nearly uniform state and maintain such a state. To be more specific, in the case of using large-sized silica particles which have undergone e.g. oil treatment to obtain high agglomerating power, external addition of the large-sized silica particles in an agglomerated state to the surfaces of toner particles tends to cause uneven distribution of the large-sized silica particles. On the other hand, in the case of using large-sized silica particles which are e.g. highly dispersive, even if the large-sized silica particles can be added externally to the surfaces of toner particles in a nearly uniform state, they become easily movable on the surfaces of toner particles under agitation load imposed thereafter in a developing unit. As a consequence, the external addition structure suffers a change, and thereby the large-sized silica particles are likely to fall into an unevenly distributed state.

When large-sized silica particles are distributed unevenly in such a way as mentioned above, the spacer effect to be produced by large-sized silica particles becomes difficult to exert on many of small-sized silica particles; as a result, many small-sized silica particles are brought into direct contact with a carrier and become likely to be excessively electrified. When many of externally added small-sized silica particles are excessively electrified, there arises an increase in total electrification amount of external additives-attached toner particles, and charge-up may occur.

And the toner particles in a charge-up state become high in field intensity required to transfer toner particles to a recording material in a transfer process as compared with normal toner particles. In other words, when image formation is carried out in a transfer field adjusted to suit for transfer of normal toner particles which are free of charge-up, the toner particles in a charge-up state are difficult to transfer, and hence images obtained are apt to have densities lower than the intended image density. Alternatively, when image formation is continued in a transfer field adjusted to suit for transfer of normal toner particles, and that in settings allowing easy electrification of toner particles, there occurs an increase in number of toner particles suffering charge-up in a developing unit, and thereby decline in densities of images obtained may continue.

On the other hand, in point of toner flowability also, cases may occur in which single use of small-sized silica particles as an external additive makes it difficult to attain toner flowability in itself, though the original aim in using small-sized silica particles is to impart flowability to toner.

More specifically, small-sized silica particles are apt to agglomerate, and therefore external addition of small-sized silica particles in an agglomerated state to toner particles tends to cause uneven distribution of small-sized silica particles among toner particles. When small-sized silica particles are unevenly distributed, the toner particle surface becomes bear in portions where the small-sized silica particles are absent, and this situation may cause lowering of toner flowability and make it difficult to attain flowability as compared with the case in which small-sized silica particles are added externally in a nearly uniform state.

In addition, small-sized silica particles in a not-yet-agglomerated state tend to be imbedded in the surfaces of toner particles by an agitation load in a developing unit, and hence reduction in flowability of toner particles may occur through the embedding of small-sized silica particles.

In the toner relating to an exemplary embodiment of the invention, small-sized silica particles and specific silica particles are therefore used in combination as external additives, and thereby excellent flowability is achieved and reduction in image density is inhibited. Reasons for these effects are inferred as follows.

Descriptions about the specific silica particles are given below.

The specific silica particles having their compressive agglomeration degree and particle compression ratio in the ranges defined above are silica particles which are high in flowability and dispersibility to toner particles, what's more which are high in agglomerative properties and adhesiveness to toner particles.

In general, silica particles are, though satisfactory in flowability, low in bulk density, and hence low in adhesiveness and difficult to agglomerate.

On the other hand, there has been known the art of treating the surfaces of silica particles with a hydrophobization treatment agent with the intention of improving not only flowability of silica particles but also dispersibility to toner particles. According to such an art, silica particles can have improvements in flowability and dispersibility to toner particles, but their low adhesiveness and poor agglomerative properties remain as they are.

In addition, there has been known another art of treating the surfaces of silica particles by using a hydrophobization treatment agent and a silicone oil in combination. According to this art, silica particles can have improvements in not only adhesiveness to toner particles but also agglomerative properties, but on the contrary, their flowability and dispersibility to toner particles tend to degrade.

That is to say, silica particles has a trade-off relationship between a combination of flowability and dispersibility to toner particles and a combination of agglomerative properties and adhesiveness to toner particles.

In contrast, the specific silica particles are, as described above, improved in four properties, namely flowability, dispersibility to toner particles, agglomerative properties and adhesiveness to toner particles, by their compressive agglomeration degree and particle compression ratio being adjusted to within the ranges defined above.

Next, meanings of the ranges specified about a compressive agglomeration degree and a particle compression ratio of the specific silica particles are described in turn.

In the first place, the meaning of the limitation of the compressive agglomeration degree of specific silica particles to within a range of 60% to 95% is explained.

The compressive agglomeration degree becomes an index of agglomerative properties of silica particles and adhesiveness to toner particles. This index is defined as the degree of resistance to crushing of a compact obtained by compressing silica particles when the compact of silica particles is made to drop.

Thus, the higher the compressive agglomeration degree of silica particles, the likelier it becomes that the silica particles have higher bulk density, the agglomeration power (cohesion power) thereof becomes strong and their adhesion to toner particles becomes strong too. Incidentally, details of the way to determine the compressive agglomeration degree will be described later.

Accordingly, the specific silica particles adjusted to have a high compressive agglomeration degree of 60% to 95% become satisfactory in adhesiveness to toner particles as well as agglomerative properties. Herein, the upper limit of the compressive agglomeration degree is set at 95% from the viewpoint of ensuring for silica particles flowability and dispersibility to toner particles while keeping the silica particles' adhesiveness to toner particles and agglomerative properties in satisfactory states.

In the second place, the meaning of the limitation of the particle compression ratio of specific silica particles to within a range of 0.20 to 0.40 is explained.

The particle compression ratio becomes an index indicating the flowability of silica particles. More specifically, the particle compression ratio is defined as a ratio of a difference between the hardened and loosened apparent specific gravities of silica particles to the hardened apparent specific gravity of the silica particles ((hardened apparent specific gravity−loosened apparent specific gravity)/hardened apparent specific gravity).

Thus, a lower particle compression ratio of silica particles indicates that the silica particles have the higher flowability. In addition, the higher flowability brings about a tendency to make the dispersibility to toner particles the higher. Incidentally, details of the way to determine the particle compression ratio will be described later.

Accordingly, the specific silica particles adjusted to have a low particle compression ratio of 0.20 to 0.40 become satisfactory in not only flowability but also dispersibility to toner particles. Herein, the lower limit of the particle compression ratio is set at 0.20 from the viewpoint of enhancing agglomerative properties as well as adhesiveness to toner particles while keeping the flowability and dispersibility to toner particles in satisfactory states.

As described above, the specific silica particles have such unique features that they flow easily and it is easy to disperse them to toner particles, what's more they are high in agglomerative properties and adhesiveness to toner particles. Thus the specific silica particles meeting the conditions that their compressive agglomeration degree and particle compression ratio fall into the ranges defined above become silica particles high in not only flowability and dispersibility to toner particles but also agglomerative properties and adhesiveness to toner particles.

In the third place, presumed actions brought about by using as external additives small-sized silica particles and the specific silica particles in combination are explained.

The specific silica particles are, as mentioned above, high in both flowability and agglomerative properties.

On the other hand, small-sized silica particles tend to cause agglomeration because of their small sizes, and they are apt to form agglomerates.

In general, toner containing toner particles and external additives attached thereto is obtained via a process of attaching external additives to toner particles by mixing toner particles and external additives with agitation under a mechanical load (hereafter referred to as an external addition process too).

In the external addition process, even when small-sized silica particles form agglomerates, these agglomerates are crushed through collisions with agglomerates formed of the specific silica particles high in agglomerative properties as well as flowability, and thereafter the agglomerates of the specific silica particles themselves are also disintegrated.

In this way, because the specific silica particles have compatibility between being agglomerative and being flowable, they repeat alternately formation and disintegration of aggregates in the external addition process and, during this course, the agglomerates thereof continue to crush aggregates of small-sized silica particles. Therefore the small-sized silica particles become likely to adhere to the surfaces of toner particles in a nearly uniform state. In addition, the specific silica particles are also high in dispersibility to toner particles, and hence they are also apt to adhere to the surfaces of toner particles in a nearly uniform state.

And because the specific silica particles are high in adhesiveness to toner particles, once they have adhere to toner particles they will be difficult to move and liberate from the toner particles even under mechanical load applied by agitation or the like in the interior of a developing unit.

In other words, when small-sized silica particles and the specific silica particles are used in combination as external additives, the small-sized silica particles are added externally in a nearly uniform state and the specific silica particles are also added externally in a nearly uniform state, what's more the nearly uniform structure of external additives becomes easy to maintain even under mechanical load.

On the other hand, the specific silica particles are larger in average equivalent circle diameter than the small-sized silica particles, and hence the specific silica particles act as a spacer. And by this spacer effect, direct contact of a carrier with small-sized silica particles present in the vicinity of the specific silica particles within a developing unit become difficult; as a result, excessive electrification of small-sized silica particles due to friction between the small-sized particles and the carrier reduces its tendency to occur.

And because the specific silica particles are attached to the surfaces of toner particles in a nearly uniform state as mentioned above, many of small-sized silica particles attached to the surfaces of toner particles resist being brought into direct contact with a carrier owing to the spacer effect of the specific silica particles, and hence they resist being excessively electrified. Thus charge-up of toner particles is resistant to occur.

Further, as mentioned above, the external addition structure of the small-sized silica particles and the specific silica particles are easy to retain, and therefore many of the small-sized silica particles attached to the surfaces of toner particles are difficult to bring into direct contact with a carrier, and the state of defying excessive electrification is easy to retain. Thus it becomes easy to maintain the state in which charge-up of toner particles is inhibited.

From the foregoing, it is inferred that the combined use of small-sized silica particles and the specific silica particles as external additives makes it easy to maintain a state in which charge-up of toner particles is inhibited, and image-density reduction traceable to charge-up is inhibited.

Furthermore, in point of toner's flowability, it is inferred that the combined use of small-sized silica particles and the specific silica particles as external additives allows external addition of the small-sized silica particles in a nearly uniform state, and thereby the effect of improving flowability of toner particles, which is an original aim in using small-sized silica particles, becomes easy to produce.

From the above considerations, it is inferred that the toner according to an exemplary embodiment of the invention is superior in flowability and can inhibit reduction in image density.

In the toner according to an exemplary embodiment of the invention, it is preferable that the specified silica particles further have a particle dispersion degree of 90% to 100%.

Herein, a meaning of a particle dispersion degree of 90% to 100% that the specific silica particles have is explained.

The particle dispersion degree becomes an index indicating the dispersibility of silica particles. This index is defined as the degree of ease in dispersing silica particles in a primary particle state to toner particles. More specifically, when the calculated coverage and the actually measured coverage of silica particles on the surfaces of toner particles are symbolized by $C_o$ and C, respectively, the particle dispersion degree is defined as a ratio between the actually measured coverage C and the calculated coverage $C_o$ on the attachment object (actually measured coverage C/calculated coverage $C_o$).

Accordingly, the higher the particle dispersion degree, the more difficult the silica particle is to agglomerate and the easier it becomes to disperse silica particles in a primary particle state to toner particles. Incidentally, details of the way to calculate the particle dispersion degree will be described later The ability of specific silica particles to be dispersed to toner particles is further enhanced by adjusting the particle dispersion degree to a high value of 90% to 100% while controlling the compressive agglomeration degree and the particle compression ratio to within the ranges defined above. As a result, the flowability of toner in its entirety is further enhanced, and besides the enhanced flowability becomes easy to maintain. In addition, the specific silica particles comes to easily attach themselves to the surfaces of toner particles in a nearly uniform state, and hence reduction in image density is easy to inhibit.

As a suitable example of the specific silica particles which are incorporated in the toner relating to an exemplary embodiment of the invention and have the foregoing features that they are not only high in flowability and dispersibility to toner particles but also high in agglomerative properties and adhesiveness to toner particles, mention may be made of silica particles the surfaces of which a siloxane compound having a relatively high weight-average molecular weight is attached to. More specifically, silica particles the surfaces of which a siloxane compound having a viscosity of 1,000 cSt to 50,000 cSt is attached to, preferably in a surface-attached amount of 0.01 mass % to 5 mass %, are a suitable example of the specific silica particles. As an example of the method for producing such specific silica particles, mention may be made of a method of using a siloxane compound having a relatively high weight-average molecular weight and making the siloxane compound adhere to the surfaces of silica particles. To be more specific, such specific silica particles can be obtained by using a siloxane compound having a viscosity of 1,000 cSt to 50,000 cSt and subjecting silica particles to surface treatment with the siloxane compound so that the siloxane compound is attached to the surfaces of silica particles in a surface-attached amount of 0.01 mass % to 5 mass %.

Herein, the surface-attached amount is defined as a proportion with respect to silica particles before undergoing surface treatment for the surfaces of silica particles (untreated silica particles). Hereafter, silica particles before undergoing surface treatment (that is, untreated silica particles) are simply referred to as silica particles too.

The specific silica particles prepared by subjecting the surfaces of silica particles to surface treatment using a siloxane compound having a viscosity of 1,000 cSt to 50,000 cSt so as to attain a surface-attached amount of 0.01 mass % to 5 mass % have improvements in flowability and dispersibility to toner particles as well as agglomerative properties and adhesiveness to toner particles, and it becomes easy for their compressive agglomeration degree and particle compression ratio to meet the requirements mentioned above. As a result, it becomes easy to inhibit lowering of flowability and reduction in image density. Although reasons therefor are uncertain, such an action is thought to be attributed to reasons mentioned below.

When a siloxane compound having a relatively high viscosity in the foregoing range is attached to the surfaces of silica particles in a small amount within the foregoing range, there develop the functions derived from properties of the siloxane compound on the silica particle surfaces. Although the developing mechanism is not clear, it is supposed that, when silica particles are flowing, because of attachment of a siloxane compound having a relatively high viscosity in a small amount within the range specified above, the release properties originated in a siloxane compound tend to develop, or adhesion between silica particles is reduced through the lowering of interparticle force due to the steric hindrance of the siloxane compound. In this way, the flowability of silica particles and the ability of silica particles to be dispersed to toner particles are further enhanced.

On the other hand, when the silica particles are pressurized, long chains of siloxane compound molecules are intertwined with one another on the surfaces of silica particles, and thereby a close packing degree of the silica particles is heightened and agglomerative force between silica particles is strengthened. And it is supposed that the agglomerative force generated between silica particles by the long chains of siloxane compound molecules being intertwined with one another is dissipated through the flowing of the silica particles. In addition thereto, adhesiveness to toner particles is heightened by the long chains of siloxane compound molecules on the silica particle surfaces.

Thus the specific silica particles to the surfaces of which a siloxane compound having its viscosity in the range specified above is attached in a small amount specified above become likely to meet the foregoing requirements for not only the compressive agglomeration degree and particle compression ratio but also the particle dispersion degree.

Details of the makeup of toner are explained below.

(Toner Particles)

Toner particles contain e.g. a binder resin. The toner particles may contain a colorant, a release agent and other additives as required.

—Binder Resin—

As examples of a binder resin, mention may be made of vinyl resins including homopolymers formed from the same kind of monomers, such as styrenes (e.g. styrene, p-chlorostyrene, α-methylstyrene), (meth)acrylic acid esters (e.g. methyl acrylalte, ethyl acrylate, n-propyl acrylate, n-butyl acrylate, lauryl acrylate, 2-ethylhexylacrylate, methyl methacrylate, ethyl methacrylate, n-propyl methacrylate, lauryl methacrylate, 2-ethylhexyl methacrylate), ethylenic unsaturated nitriles (e.g. acrylonitrile, methacrylonitrile), vinyl ethers (e.g. vinyl methyl ether, vinyl isobutyl ether), vinyl ketones (e.g. vinyl methyl ketone, vinyl ethyl ketone, vinyl isopropenyl ketone) or olefins (e.g. ethylene, propylene, butadiene), and copolymers formed from combinations of two or more kinds of the monomers recited above.

Other examples of a binder resin include non-vinyl resins, such as epoxy resin, polyester resin, polyurethane resin, polyamide resin, cellulose resin, polyether resin and denatured rosin, mixtures of these non-vinyl resins and the vinyl resins as recited above, and graft polymers obtained by polymerizing vinyl monomers in the presence of the resins or mixtures as recited above.

These binder resins may be used alone or as combinations of two or more thereof.

Of those binder resins, polyester resin is preferred over the others.

Examples of polyester resin include publicly known polyester resins.

Examples of such polyester resins include condensation polymers formed from polycarboxylic acids and polyhydric alcohols. By the way, polyester resins usable herein may be any of commercially available polyester resins or synthesized ones.

Examples of a polycarboxylic acid include aliphatic dicarboxylic acids (e.g. oxalic acid, malonic acid, maleic acid, fumaric acid, citraconic acid, itaconic acid, glutaconic acid, succinic acid, alkenylsuccinic acid, adipic acid, sebacic acid), alicyclic dicarboxylic acids (e.g. cyclohexanedicarboxylic acid), aromatic dicarboxylic acids (e.g. terephthalic acid, isophthalic acid, phthalic acid, naphthalenedicarboxylic acid), anhydrides of the acids as recited above, and lower alkyl (the carbon number of which is e.g. from 1 to 5) esters of the acids as recited above. Among them, preferred polycarboxylic acids are e.g. aromatic dicarboxylic acids.

As polycarboxylic acids, tri- or higher-valent carboxylic acids assuming crosslinked or branched structure may be used in combination with dicarboxylic acids. Examples of such a tri- or higher-valent carboxylic acid include trimellitic acid, pyromellitic acid, anhydrides of these acids and lower alkyl (the carbon number of which is e.g. from 1 to 5) esters of these acids.

Polycarboxylic acids may be used alone or as combinations of two or more thereof.

Examples of a polyhydric alcohol include aliphatic diols (e.g. ethylene glycol, diethylene glycol, triethylene glycol, propylene glycol, butanediol, hexanediol, neopentyldiol), alicyclic diols (e.g. cyclohexanediol, cyclohexanedimethanol, hydrogenated bisphenol A) and aromatic diols (e.g. ethylene oxide adducts of bisphenol A, propylene oxide adducts of bisphenol A). Among them, preferred polyhydric alcohols are e.g. aromatic diols and alicyclic diols, and far preferred ones are aromatic diols.

As polyhydric alcohols, tri- or higher-hydric alcohols assuming crosslinked or branched structure may be used in combination with diols. Examples of a tri- or higher-hydric alcohol include glycerin, trimethylolpropane and pentaerythritol.

Polyhydric alcohols may be used alone or as combinations of two or more thereof.

The glass transition temperature (Tg) of polyester resin is preferably from 50° C. to 80° C., far preferably from 50° C. to 65° C.

By the way, the glass transition temperature is determined from a DSC curve obtained by differential scanning calorimetry (DSC), and more specifically, it is determined by "the extrapolated glass transition initiating temperature" described in the way to determine a glass transition temperature in accordance with JIS K 7121-1987, entitled "Method for Measuring Transition Temperatures of Plastics".

The weight-average molecular weight (Mw) of polyester resin is preferably from 5,000 to 1,000,000, far preferably from 7,000 to 500,000.

The number-average molecular weight (Mn) of polyester resin is preferably from 2,000 to 100,000.

The molecular-weight distribution, Mw/Mn, of polyester resin is preferably from 1.5 to 100, far preferably from 2 to 60.

By the way, the weight-average molecular weight and the number-average molecular weight are measured by gel permeation chromatography (GPC). The molecular weight measurement by GPC is carried out by using GPC•HLC-8120GPC, made by TOSOH CORPORATION, as a measuring instrument, TSKgel SuperHM-M (15 cm), made by TOSOH CORPORATION, as a column and THF as a solvent. The weight-average molecular weight and the number-average molecular weight are calculated from the result of this measurement by the use of the molecular-weight calibration curve prepared from monodisperse polystyrene standard samples.

Polyester resins can be produced by well-known methods. To be more specific, polyester resins can be produced e.g. by a method of carrying out polymerization reaction in a reaction system at a temperature of 180° C. to 230° C. and under reduced pressure, if necessary, while excluding water and alcohol produced during condensation from the reaction system.

Additionally, when monomers as starting material are insoluble or incompatible at a reaction temperature, they may be dissolved by addition of a high boiling solvent as dissolving assistant. In this case, the polycondensation reaction is carried out as the dissolving assistant is distilled off from the reaction system. When a monomer poor in compatibility is present, it is appropriate that the monomer poor in compatibility and an acid or alcohol intended to undergo polycondensation be subjected to condensation in advance and then to polycondensation together with the main constituent.

The suitable binder resin content is e.g. from 40 to 95 mass %, preferably from 50 to 90 mass %, far preferably from 60 to 85 mass %, with respect to an entire amount of the toner particles.

—Colorant—

Examples of a colorant include various kinds of pigments, such as carbon black, Chrome Yellow, Hansa Yellow, Benzidine Yellow, Threne Yellow, Guinoline Yellow, Pigment Yellow, Permanent Orange GTR, Pyrazolone Orange, Vulcan Orange, Watchung Red, Permanent Red, Brilliant Carmine 3B, Brilliant Carmine 6B, Du pont Oil Red, Pyrazolone Red, Lithol Red, Rhodamine B lake, Lake Red C, Pigment Red, Rose Bengal, Aniline Blue, Ultramarine Blue, Calco Oil Blue, Methylene Blue chloride, Phthalocyanine Blue, Pigment Blue, Phthalocyanine Green and Malachite Green oxalate, and various kinds of dyes such as acridine dyes, xanthene dyes, azo dyes, benzoquinone dyes, azine dyes, anthraquinone dyes, thioindigo dyes, dioxazine dyes, thiazine dyes, azomethine dyes, indigo dyes, phthalocyanine dyes, aniline black dyes, polymethine dyes, triphenylmethane dyes, diphenylmethane dyes and thiazole dyes.

As to these colorants, one colorant alone may be used or two or more colorants may be used in combination.

Any of these colorant may be used after receiving surface treatment as necessary, or it may be used in combination with a dispersant. In addition, two or more different kinds of colorants may be used in combination.

The suitable colorant content is e.g. from 1 to 30 mass %, preferably from 3 to 15 mass %, with respect to an entire amount of the toner particles.

—Release Agent—

Examples of a release agent include, but not limited to, natural wax such as hydrocarbon wax, carnauba wax, rice wax or candelilla wax, synthetic or mineral oil wax such as Montan wax, fatty acid esters and ester wax such as Montanic acid ester.

The melting temperature of a release agent is preferably from 50° C. to 110° C., far preferably from 60° C. to 100° C.

By the way, the melting temperature is determined from a DSC curve obtained by differential scanning calorimetry (DSC) as the melting peak temperature described in the way to determine a melting temperature in accordance with JIS K 7121-1987, entitled "Method for Measuring Transition Temperatures of Plastics".

The suitable release agent content is e.g. from 1 to 20 mass %, preferably from 5 to 15 mass %, with respect to an entire amount of the toner particles.

—Other Additives—

Examples of other additives include well-known additives such as a magnetic substance, a static control agent and inorganic powder. These additives are incorporated into toner particles as internal additives.

—Characteristics of Toner Particles—

The toner particles may be toner particles of monolayer structure or those of the so-called core/shell structure constituted of a core portion (core particle) and a layer covering the core portion (a shell layer).

Herein, it is appropriate that each toner particle of core/shell structure be formed of a core portion containing a binder resin and, if necessary, other additives such as a colorant and a release agent, and a covering layer containing a binder resin.

The volume-average particle size (D50v) of toner particles is preferably from 2 μm to 10 μm, far preferably from 4 μm to 8 μm.

By the way, the various types of average particle sizes and various particle-size distribution indexes of toner particles are measured by using a Coulter Multisizer II (Beckman Coulter Inc.) and ISOTON-II (Beckman Coulter Inc.) as an electrolytic solution.

At the time of measurements, 0.5 mg to 50 mg of a sample to be measured is added to 2 ml of a 5% aqueous solution of surfactant (preferably sodium alkylbenzenesulfonate) as a dispersant. This admixture is added to 100 ml to 150 ml of an electrolyte.

The sample-suspended electrolyte is subjected to one-minute dispersion treatment with an ultrasonic dispersing device, and the particle-size distribution of particles having particle sizes ranging from 2 μm to 60 μm is determined by means of a Coulter Multisizer II provided with apertures having an aperture diameter of 100 μm. Herein, the number of sampled particles is 50,000.

Volume and number distributions accumulated from the smaller-size side are plotted, respectively, verses particle-size ranges (channels) divided on the basis of particle size distribution to be measured, and therein, respectively, the particle sizes at which the accumulation reaches 16% are defined as a volume particle size D16v and a number particle size D16p, the particle sizes at which the accumulation reaches 50% are defined as a volume-average particle size D50v and a number-average particle size D50p, and the particle sizes at which the accumulation reached 84% are defined as a volume particle size D84v and a number particle size D84p.

By using these data, the volume-average particle size distribution index (GSDv) is calculated in the form of $(D84v/D16v)^{1/2}$, and the number-average particle size distribution index (GSDp) is calculated in the form of $(D84p)/(D16p)^{1/2}$.

The average circularity of toner particles is preferably from 0.90 to 0.98, far preferably from 0.95 to 0.98.

The average circularity of toner particles is determined by calculating (equivalent circle circumference)/(circumference) ratios [(circumference of a circle having the same projected area as a particle image has)/(circumference of the projected image of a particle) ratios]. More specifically, it is a value measured through the following procedure.

To begin with, a toner (developer) as an object of measurement is dispersed into a water containing a surfactant. Then, external additives are removed from the toner by ultrasonic treatment, and thereby toner particles are obtained.

The thus obtained toner particles are collected under suction, formed into a flat flow, instantaneously exposed to strobe emission, and thereby particle images are captured as static images, and then the average circularity of the particle images is determined from image analysis of the particle images by the use of a flow-type particle-image analyzer (FPIA-2100, made by Sysmex Corporation). And the sampling number for determination of the average circularity is set at 3,500.

(External Additives)

External additives include small-sized silica particles and specific silica particles. The external additives may include external additives other than the small-sized silica particles and the specific silica particles. In other words, only a combination of small-sized silica particles and specific silica particles may be added externally to toner particles, or small-sized silica particles, specific silica particles and other additives may be externally added together to toner particles.

—Oil—

Silica particles may be surface-treated with an oil. As an example of an oil for use in surface treatment of silica particles, mention may be made of one or more compounds chosen from the group consisting of lubricants, oils and fats. Examples of an oil include a silicone oil, a paraffin oil, a fluorine-containing oil and a vegetable oil. As to the oil, only one kind of oil may be used, or two or more kinds of oil may be used in combination.

Examples of a silicone oil include dimethyl silicone oil, methylphenyl silicone oil, chlorophenyl silicone oil, methylhydrogen silicone oil, alkyl-modified silicone oil, fluorine-modified silicone oil, polyether-modified silicone oil, alcohol-modified silicone oil, amino-modified silicone oil, epoxy-modified silicone oil, epoxy- and polyether-modified silicone oil, phenol-modified silicone oil, carboxyl-modified silicone oil, mercapto-modified silicone oil, acryl- or methacryl-modified silicone oil, and α-methylstyrene-modified silicone oil.

As an example of a paraffin oil, mention may be made of liquid paraffin.

As examples of a fluorine-containing oil, mention may be made of a fluorine-containing oil and fluorine-containing oil chloride.

As an example of a mineral oil, mention may be made of a machine oil.

As examples of a vegetable oil, mention may be made of rapeseed oil and palm oil.

Of these oils, silicone oils are preferred over the others in terms of toner-charge retention characteristics and cleaning properties. Application of a silicone oil makes it easy to perform surface treatment of silica particle surfaces in a state that the oil forms a nearly-uniform thin layer on the silica particle surfaces.

[Small-Sized Silica Particles]

The small-sized silica particles are silica particles having an average equivalent circle diameter of 10 nm to 120 nm.

As to the small-sized silica particles, it is essential only that the main constituent thereof be silica, or $SiO_2$, and they may be in a crystalline state or an amorphous state. In addition, the silica particles may be produced using as a raw material a silicon compound such as water glass or alkoxysilane or obtained by grinding quartz.

Examples of small-sized silica particles include sol-gel silica particles, aqueous colloidal silica particles, alcoholic silica particles, fumed silica particles obtained by a vapor-phase method and fused silica particles. Of these silica particles, fumed silica particles are preferred over the others from the viewpoint of making it easy to enhance the rate of covering toner particles.

The small-sized silica particles may receive hydrophobization treatment. The hydrophobization treatment can be performed e.g. by the immersion of silica particles before receiving hydrophobization treatment into a hydrophobization treatment agent.

As examples of a hydrophobization treatment agent used for hydrophobization treatment, mention may be made of silane coupling agents and silicone oils.

Examples of a silane coupling agent include hexamethyldisilazane trimethylsilane, trimethylchlorosilane, dimethyldichlorosilane, methyltrichlorosilane, allyldimethylchlorosilane, benzyldimethylchorosilane, methyltrimethoxysilane, methyltriethoxysilane, isobutyltrimethoxysilane, dimethyldimethoxysilane, diethyldiethoxysilane, trimethylmethoxysilane, hydroxypropyltrimethoxysilane, phenyltrimethoxysilane, n-butyltrimethoxysilane, n-hexadecyltrimethoxysilane, n-octadecyltrimethoxysilane, vinyltrimethoxysilane, vinyltriethoxysilane, γ-methacryloxypropyltrimethoxysilane and vinyltriacetoxysilane.

Examples of a silicone oil include dimethylpolysiloxane, methylhydrogenpolysiloxane and methylphenylpolysiloxane.

Of these hydrophobization treatment agents, organosilicon compounds having trimethylsilyl groups such as trimethylmethoxysilane and hexamethyldisilazane, especially hexamethyldisilazane, are preferable to the others.

Additionally, other examples of a hydrophobization treatment agent include publicly known hydrophobization treatment agents such as titanate coupling agents and aluminum coupling agents.

Hydrophobization treatment agents may be used alone or as combinations of two or more thereof.

The amount of a hydrophobization treatment agent used for the treatment has no particular limits, but from the viewpoint of achieving hydrophobing effects, it is preferably from 1 mass % to 60 mass %, far preferably from 5 mass % to 40 mass %, further preferably 10 mass % to 30 mass %, with respect to the total mass of silica particles before receiving hydrophobization treatment.

By the way, oil such as a silicone oil (one or more compounds chosen from the group consisting of lubricants, oils and fats) may be used as a hydrophobization treatment agent. In this case, from the viewpoint of maintaining the flowability of toner, the amount of such a hydrophobization treatment agent is preferably 5 mass % or below, far preferably 3 mass % or below, further preferably 1 mass % or below, with respect to the total mass of silica particles before receiving hydrophobization treatment.

In addition, when an oil such as a silicone oil is used as a hydrophobization treatment agent, in point of flowability of toner, the amount of free oil is preferably 3 mass % or below, far preferably 3 mass %, further preferably 0 mass %.

Herein, the amount of free oil is defined as a proportion of free oil to the whole of small-sized silica particles. And the amount of free oil is a value measured in the following way.

Proton NMR measurement is made on small-sized silica particles by the use of AL-400 made by JEOL Ltd. (magnetic field: 9.4 T (H nuclei, 400 MHz)). A sample, a deuterated chloroform solvent and TMS as a reference substance are charged into a zirconia sample tube (diameter: 5 mm). This sample tube is set in AL-400, and measurements are made e.g. under conditions that the frequency is Δ87 kHz/400 MHz (=Δ20 ppm), the measurement temperature is 25° C., the number of add-up times is 16 and the resolution is 0.24 Hz (32,000 point), and from the peak intensity of free-oil origin the amount of free oil is calculated with the aid of a calibration curve.

For example, when dimethyl silicone oil is used as the oil, NMR measurements are made on untreated silica particles and dimethyl silicone oil (sprayed in amounts of the order of 5 levels), and therefrom is prepared a calibration curve showing a relation between the amount of free oil and the intensity of an NMR peak. And the amount of free oil is worked out based on the calibration curve.

—Average Equivalent Circle Diameter—

The average equivalent circle diameter of small-sized silica particles is from 10 nm to 120 nm, and in terms of toner's flowability and inhibition of reduction in image density, it is preferably from 20 nm to 115 nm, far preferably from 30 nm to 110 nm, further preferably from 40 nm to 100 nm.

Because the small-sized silica particles having their average equivalent circle diameter in the foregoing range are used in an exemplary embodiment of the invention, agglomerates of the small-sized silica particles are easier to crush by agglomerates of the specific silica particles in the external addition process as compared to those of silica particles having an average equivalent circle diameter being smaller than the foregoing range. Accordingly, as mentioned above, the small-sized silica particles are apt to adhere to the surfaces of toner particles in a nearly uniform state, and hence it is supposed that reduction in image density is inhibited.

In addition, the use of the small-sized silica particles having their average equivalent circle diameter in the foregoing range in an exemplary embodiment of the invention is easier to give the spacer effect of the specific silica particles as compared to the use of silica particles having an average equivalent circle diameter exceeding the foregoing range. Accordingly, as mentioned above, the small-sized silica particles are difficult to bring into direct contact with a carrier, and hence it is supposed that image density reduction arising from charge-up is inhibited.

The average equivalent circle diameter of the small-sized silica particles is determined in the same manner as described later about that of the specific silica particles.

By the way, when it is intended to determine the average equivalent circle diameter of small-sized silica particles from the toner, external additives are separated from the toner, and the small-sized silica particles are isolated from the separated external additives in the following manner.

The toner is charged and dispersed into methanol. After agitating, the dispersion is treated in an ultrasonic bath, and thereby external additives are stripped off from the toner surface. Thereafter, the toner is settled out by centrifugal separation, and only methanol in which the external additives are dispersed is recovered. Then, the methanol is vaporized, and thereby the external additive can be extracted. The thus obtained external additives are charged and dispersed into a 3:7 water-methanol mixed solution, and agitated. Thereafter, ingredients other than small-sized silica particles are settled out by centrifugal separation, and only the solution in which small-sized silica particles are dispersed is recovered. Then, the recovered solution is vaporized, and thereby the small-sized silica particles can be extracted.

—Amount of External Additives—

In terms of the flowability of toner and inhibition of reduction in image density, the amount of small-sized silica particles added externally is preferably from 0.5 mass % to 5.0 mass %, far preferably from 0.8 mass % to 3.0 mass %, with respect to toner particles.

[Specific Silica Particles]

—Compressive Agglomeration Degree—

The compressive agglomeration degree of specific silica particles is from 60% to 95%, but from the viewpoint of ensuring flowability and dispersibility to toner particles while retaining the agglomerative properties and adhesiveness to toner particles in satisfactory condition (namely, from the viewpoint of inhibiting reductions in flowability of toner and image density), it is preferably from 65% to 95%, far preferably from 70% to 95%, further preferably from 80% to 95%.

The compressive agglomeration degree is worked out in the following manner.

Specific silica particles in an amount of 6.0 g are charged into a disc-shaped die having a diameter of 6 cm. Then, the die is compressed under pressure of 5.0 t/cm$^2$ for 60 seconds by means of a compression press (made by Maekawa Testing Machine MFG Co., Ltd.), thereby providing the compact of compressed disc-shaped specific silica particles (hereafter referred to as the compact before being dropped). Thereafter, the mass of the compact before being dropped is measured.

Next, the compact before being dropped is placed on a sieve net having a mesh size of 600 μm, and made to drop by using a vibration sieve machine (VIBRATING MVB-1, item number, a product of TSUTSUI SCIENTIFIC INSTRUMENTS CO., LTD.) under conditions that the vibration amplitude is 1 mm and the vibration time is 1 minute. By doing so, specific silica particles are dropped from the compact before being dropped through the sieve net and the compact of specific silica particles remains on the sieve net. Thereafter, the mass of the remaining compact of specific silica particles (hereinafter referred to as the compact after undergoing the drop operation) is measured.

And the compressive agglomeration degree is calculated from a ratio of the mass of the compact after undergoing the drop operation to the mass of the compact before being dropped by the use of the following expression (1).

Compressive agglomeration degree=(mass of compact after undergoing drop operation/mass of compact before being dropped)×100 Expression (1):

—Particle Compression Ratio—

The particle compression ratio of specific silica particles is from 0.20 to 0.40, but from the viewpoint of ensuring flowability and dispersibility to toner particles while retaining the agglomerative properties and adhesiveness to toner particles in satisfactory condition (namely, from the viewpoint of inhibiting reductions in flowability of toner and image density), it is preferably from 0.24 to 0.38, far preferably from 0.28 to 0.36.

The particle compression ratio is worked out in the following manner.

The loosened apparent specific gravity and hardened apparent specific gravity of silica particles are measured with a powder tester (Model PT-S, item number, a product of HOSOKAWA MICRON CORPORATION). And the particle compression ratio is determined by calculating a ratio of a difference between the hardened and loosened apparent specific gravities of the silica particles to the hardened apparent specific gravity of the silica particles, which is given by the following Expression (2).

Particle compression ratio=(hardened apparent specific gravity−loosened apparent specific gravity)/hardened apparent specific gravity) Expression (2):

Herein, the term "loosened apparent specific gravity" is a measured value derived from filling a vessel having a volume of 100 $cm^3$ with silica particles and measuring the weight thereof, and refers to the filling specific gravity of specific silica particles in a state of having filled the vessel by free-fall drop. And the term "hardened apparent specific gravity" refers to the apparent specific gravity in a state that the specific silica particles are deaerated, rearranged and more densely packed in the vessel by repeating the application of impacts (tapping) to the bottom of the vessel 180 times under conditions that the stroke length is 18 mm and the tapping speed is 50 times per minute.

—Particle Dispersion Degree—

From the viewpoint of further enhancing the dispersibility to toner particles (in other words, inhibiting reduction in image density), the dispersion degree of the specific silica particles is preferably from 90% to 100%, far preferably from 95% to 100%.

The particle dispersion degree is a ratio between the actually measured coverage C and the calculated coverage $C_o$ on the toner particles, and calculated by using the following Expression (3).

Particle dispersion degree=actually measured coverage $C$/calculated coverage $C_o$ Expression (3):

Herein, when the volume average particle size of toner particles is symbolized by dt (m), the average equivalent circle diameter of specific silica particles by da (m), the specific gravity of toner particles by pt, the specific gravity of specific silica particles by ρa, the weight of toner particles by Wt (kg) and the addition amount of specific silica particles by Wa (kg), the calculated coverage $C_0$ of specific silica particles on the surfaces of toner particles can be worked out by the following Expression (3-1).

Calculated coverage $C_0=\sqrt{3}/(2\pi)\times(\rho t/\rho a)\times(dt/da)\times(Wa/Wt)\times100(\%)$ Expression (3-1):

The actually measured coverage C of specific silica particles on the surfaces of toner particles is worked out by performing measurement of the signal strength of silicon atoms originated in specific silica particles on each of the toner particles alone, specific silica particles alone and specific silica particles covering (attached to) the surfaces of toner particles by means of an X-ray photoelectron spectrometer (XPS) (JPS-9000MX, made by JEOL Ltd.) and calculation according to the following Expression (3-2).

Actually measured coverage $C=(z-x)/(y-x)\times100(\%)$ Expression (3-2):

In Expression (3-2), x represents the signal strength of silicon atoms originated in the specific silica particles of toner particles alone, y represents the signal strength of silicon atoms originated in the specific silica particles of specific silica particles alone and z represents the signal strength of silicon atoms originated in the specific silica particles of toner particles which is covered with (to which are attached) specific silica particles.

—Average Equivalent Circle Diameter—

The average equivalent circle diameter of specific silica particles has no particular limits so long as it is greater than that of small-sized silica particles, but from the viewpoint of ensuring for specific silica particles satisfactory flowability, dispersibility to toner particles, agglomerative properties and adhesiveness to toner particles (particularly in terms of flowability and inhibition of reduction in image density), it is preferably from 40 nm to 200 nm, far preferably from 50 nm to 180 nm, further preferably from 60 nm to 160 nm.

Additionally, in terms of flowability of toner and inhibition of reduction in image density, the average equivalent circle diameter of specific silica particles is preferably 1.2 to 25 times, far preferably 1.8 to 15 times, further preferably 2.4 to 10 times, greater than that of small-seized silica particles.

The average equivalent circle diameter D50 of specific silica particles is obtained by observing primary particles after externally adding specific silica particles to toner particles under a scanning electron microscope (SEM) (S-4100, a product of Hitachi Ltd.) and photographing primary particle images, capturing the photographed images into an image analyzer (LUZEXIII, a product of NIRECO), measuring the areas of individual particles through the image analyses of primary particles, and calculating equivalent circle diameters from the values of these areas. And 50% diameter (D50) at a cumulative frequency of 50% on a volume basis of the equivalent circle diameters thus obtained is defined as the average equivalent circle diameter D50 of specific silica particles. Incidentally, the magnification of the microscope is adjusted so that about 10 to about 50 specific silica particles can be seen within one field of view, and observation results in a plurality of fields of view are combined, and therefrom the equivalent circle diameter of primary particles is determined.

—Average Circularity—

The specific silica particles may be spherical or irregular in shape, but from the viewpoint of ensuring for the specific silica particles satisfactory flowability, dispersibility to toner particles, agglomerative properties and adhesiveness to toner particles (particularly in terms of flowability and inhibition of reduction in image density), the average circularity of specific silica particles is preferably from 0.85 to 0.98, far preferably from 0.90 to 0.98, further preferably from 0.93 to 0.98.

The average circularity of specific silica particles is determined in the following manner.

First, primary particles of toner particles having undergone external addition of silica particles are observed under SEM and photographed, and then from the analyses of the photographed planar images of the primary particles, the circularity of the specific silica particles is determined as 100/SF2 calculated from the following Expression.

$$\text{Circularity}(100/SF2)=4\pi\times(A/I^2) \qquad \text{Expression:}$$

In the Expression, I represents the circumference length of primary particles on a photographed image, and A represents the projected area of primary particles.

And the average circularity of specific silica particles is obtained in the form of a 50% circularity at the cumulative frequency of circularities of 100 primary particles obtained by the foregoing planar image analyses.

Now is explained a method for determining each of characteristics (compressive agglomeration degree, particle compression ratio, particle dispersion degree and average circularity) of the specific silica particles from the toner.

To begin with, the external additives are separated from the toner in the following manner. The toner is charged and dispersed into methanol. After agitation, the dispersion is treated in an ultrasonic bath, and thereby external additives are stripped off from the toner surface. Thereafter, the toner is settled out by centrifugal separation, and only methanol in which the external additives are dispersed is recovered. Then, the methanol is vaporized, and thereby the external additive can be extracted. The thus obtained external additives are charged and dispersed into a 3:7 water-methanol mixed solution, and agitated. Thereafter, specific silica particles are settled out by centrifugal separation, recovered and then dried. Thus the specific silica particles can be extracted from the toner.

And measurements of the foregoing characteristics are made on the isolated specific silica particles.

Makeup of the specific silica particles will now be described in detail.

—Specific Silica Particle—

The specific silica particles are particles containing silica (i.e. $SiO_2$) as a main constituent, and they may be in a crystalline or amorphous state. The specific silica particles may be particles produced from a silicon compound such as water glass or an alkoxysilane, or they may be particles obtained by pulverizing quartz.

Examples of specific silica particles include silica particles made by a sol-gel method (hereafter referred to as "sol-gel silica particles"), aqueous colloidal silica particles, alcoholic silica particles, fumed silica particles obtained by a vapor-phase method and fused silica particles. Of these silica particles, sol-gel silica particles are preferred over the others.

—Surface Treatment—

In order that the specific silica particles can have their compressive agglomeration degree, particle compression ratio and particle dispersion degree in the ranges specified above respectively, it is preferred that surface treatment with a siloxane compound be given to the specific silica particles.

As a surface treatment method, it is suitable to utilize supercritical carbon dioxide and subject the surfaces of specific silica particles to surface treatment in the supercritical carbon dioxide. By the way, methods for the surface treatment are described later in detail.

—Siloxane Compound—

As to the siloxane compound, there is no particular restrictions so long as it has a siloxane skeleton in its molecular structure.

The siloxane compound is e.g. a silicone oil or a silicone resin. Of these compounds, a silicone oil is preferable from the viewpoint of allowing the surfaces of specific silica particles to be treated in a nearly uniform state.

Examples of a silicon oil include dimethylsilicone oil, methylhydrogensilicone oil, methylphenylsilicone oil, amino-modified silicone oil, epoxy-modified silicone oil, carboxyl-modified silicone oil, carbinol-modified silicone oil, methacryl-modified silicone oil, mercapto-modified silicone oil, phenol-modified silicone oil, polyether-modified silicone oil, methylstyryl-modified silicone oil, alkyl-modified silicone oil, higher fatty acid-modified silicone oil, higher fatty acid amid-modified silicone oil and fluorine-modified silicone oil. Among these silicone oils, dimethylsilicone oil, methylhydrogensilicone oil and amino-modified silicone oil are preferred over the others.

The siloxane compounds as recited above may be used alone, or as combinations of two or more thereof.

—Viscosity—

The viscosity (kinematic viscosity) of siloxane compound is preferably from 1,000 cSt to 50,000 cSt, far preferably from 2,000 cSt to 30,000 cSt, further preferably from 3,000 cSt to 10,000 cSt, from the viewpoint of imparting satisfactory flowability, dispersibility to toner particles, agglomerative properties and adhesiveness to toner particles (notably satisfactory flowability and inhibition of reduction in image density) to the specific silica particles.

The viscosity of a siloxane compound is determined in the following procedure. Specific silica particles are added to toluene and dispersed for 30 minutes by means of an ultrasonic dispersing machine. Thereafter, the supernatant is collected. Herein, a toluene solution containing the siloxane compound in a concentration of 1 g/100 ml is prepared. The specific viscosity $[\eta_{sp}]$ of this toluene solution (25° C.) is determined by the following expression (A).

$$\eta_{sp}=\eta_{sp}=(\eta/\eta_0)-1 \qquad \text{Expression (A):}$$

($\eta_0$: viscosity of toluene, $\eta$: viscosity of solution)

Next, the specific viscosity $[\eta_{sp}]$ is substituted into Huggins relation shown by the following Expression (B), and thereby the intrinsic viscosity $[\eta]$ is determined.

$$\eta_{sp}=[\eta]+K'[\eta]^2 \qquad \text{Expression (B):}$$

(K': Huggins's constant, K'=0.3 (when $\eta$=1 to 3 is adapted)

Then, the intrinsic viscosity $[\eta]$ is substituted into the A. Kolorlov's equation shown by the following Expression (C), and thereby the molecular weight M is determined.

$$[\eta]=0.215\times10^{-4}M^{0.65} \qquad \text{Expression (C):}$$

The molecular weight M is substituted into the A. J. Barry's equation shown by the following Expression (D), and thereby the siloxane viscosity [η] is determined.

$$\log \eta = 1.00 + 0.123M^{0.5} \quad \text{Expression (D):}$$

—Amount of Surface Attachment—

From the viewpoint of ensuring for specific silica particles satisfactory flowability, dispersibility to toner particles, agglomerative properties and adhesiveness to toner particles (notably satisfactory flowability and inhibition of reduction in image density), the amount of a siloxane compound attached to the surfaces of specific silica particles is preferably from 0.01 mass % to 5 mass %, far preferably from 0.05 mass % to 3 mass %, further preferably from 0.10 mass % to 2 mass %, with respect to the silica particles (the silica particles before undergoing surface treatment).

The amount of surface attachment is determined in the following manner.

The specific silica particles in an amount of 100 mg are dispersed into 1 mL of chloroform, and thereto is added 1 μL of DMF (N,N-dimethylformamide) as an internal standard. Thereafter, the resulting dispersion is sonicated for 30 minutes by means of an ultrasonic cleaning machine, and extraction of a siloxane compound into the chloroform solution is carried out. Then, the extract obtained is subjected to spectral measurement of hydrogen nuclei by means of a nuclear magnetic resonance spectrometer, Model JNM-AL400 (made by JEOL DATUM CO. LTD.), and the amount of siloxane compound is determined from a ratio of the area of the peak of siloxane compound origin to the area of the peak of DMF origin. And the thus determined amount of siloxane compound leads to the amount of surface attachment.

Herein, it is preferred that the specific silica particles be surface-treated by a siloxane compound having a viscosity of 1,000 cSt to 50,000 cSt and the amount of the siloxane compound attached to surfaces of the specific silica particles be from 0.01 mass % to 5 mass %.

By satisfying the foregoing requirements, it becomes easy to obtain specific silica particles having not only satisfactory flowability and dispersibility to toner particles but also improved agglomerative properties and adhesiveness to toner particle.

—Amount of External Addition—

In terms of flowability of toner and inhibition of reduction in image density, the amount (content) of externally-added specific silica particles is preferably from 0.1 mass % to 6.0 mass %, far preferably from 0.3 mass % to 4.0 mass %, further preferably from 0.5 mass % to 2.5 mass %, with respect to toner particles.

Additionally, in terms of flowability of toner and inhibition of reduction in image density, the amount (content) of externally-added specific silica particles is preferably 0.3 to 5 times larger, far preferably 0.4 to 4 times larger, than the amount (content) of externally-added small-sized silica particles.

[Method for Producing Specific Silica Particles]

The specific silica particles are produced by surface-treating the surfaces of silica particles with a siloxane compound having a viscosity of 1,000 cSt to 50,000 so that the amount of surface attachment reaches 0.01 mass % to 5 mass % with respect to the silica particles.

According to such a method for producing specific silica particles, silica particles can be produced which are not only satisfactory in flowability and dispersibility to toner particles but also improved in agglomerative properties and adhesiveness to toner particles.

Examples of the foregoing surface treatment method include a method of subjecting the surfaces of silica particles to surface treatment with a siloxane compound in supercritical carbon dioxide, and a method of surface-treating the surfaces of silica particles with a siloxane compound in the air.

To be more specific, as examples of the foregoing surface treatment method, mention may be made of a method of utilizing supercritical carbon dioxide, dissolving a siloxane compound in the supercritical carbon dioxide and making the siloxane compound attach to the surfaces of silica particles; a method of making a siloxane compound attach to the surfaces of silica particles in the air by applying a solution containing the siloxane compound and a solvent capable of dissolving the siloxane compound to the surfaces of silica particles (e.g. by spraying or coating); and a method of adding in the air a solution containing a siloxane compound and a solvent capable of dissolving the siloxane compound to a dispersion of silica particles, maintaining the admixture of the solution and the dispersion of silica particles as it is, and thereafter drying the admixture.

Of these surface treatment methods, the method of utilizing supercritical carbon dioxide and making a siloxane compound attach to the surfaces of silica particles is preferable to the others.

When the surface treatment is carried out within supercritical carbon dioxide, the siloxane compound reaches a state of being dissolved in the supercritical carbon dioxide. Because the supercritical carbon dioxide has the property of being low in surface tension, it is inferred that the siloxane compound in a state of being dissolved in supercritical carbon dioxide tends to disperse and reach to depths of pores in the surfaces of silica particles in concert with the supercritical carbon dioxide, and thereby not only the surfaces of silica particles receives surface treatment with the siloxane compound but also the surface treatment extends to depths of pores in the surface of silica particles.

Thus, it is supposed that the silica particles having undergone surface treatment with a siloxane compound in supercritical carbon dioxide become silica particles in a state that their surfaces are treated almost uniformly with the siloxane compound (e.g. a state that a surface treatment layer is formed in a thin-film shape).

Additionally, in the method for producing specific silica particles, surface treatment for imparting hydrophobicity to the surfaces of silica particles may be carried out through the use of a hydrophobization treatment agent in addition to a siloxane compound within supercritical carbon dioxide.

In this case, it is inferred that the hydrophobization treatment agent, together with the siloxane compound, becomes a state of being dissolved in supercritical carbon dioxide, and both the siloxane compound and the hydrophobizaion treatment agent in a state of being dissolved in the supercritical carbon dioxide tend to disperse and reach to depths of pores in the surface of silica particles in concert with the supercritical carbon dioxide, and it is supposed that not only the surfaces of silica particles but also depths of pores are surface-treated with the siloxane compound and the hydrophobization treatment agent.

Consequently, silica particles having undergone surface treatment with the siloxane compound and the hydrophobization treatment agent in the supercritical carbon dioxide not only become a state that their surfaces are treated almost uniformly with the siloxane compound and the hydrophobization treatment agent but also tend to get high hydrophobicity.

In addition, as to the production method of specific silica particles, in other production processes of silica particles (e.g. solvent removal process), supercritical carbon dioxide may be utilized.

As an example of the specific silica particles production method utilizing supercritical carbon dioxide in other production processes, mention may be made of a silica particles production method having a process of preparing a silica-particle dispersion containing silica particles and a solvent constituted of alcohol and water in accordance with a sol-gel method (hereafter referred to as "dispersion preparing process"), a process of removing the solvent from the silica-particle dispersion by circulating supercritical carbon dioxide (hereafter referred to as "solvent removing process") and a process of subjecting the surfaces of silica particles after removal of the solvent to surface treatment with a siloxane compound within supercritical carbon dioxide (hereafter referred to as "surface treating process).

When the removal of a solvent from a dispersion of silica particles is carried out through the utilization of supercritical carbon dioxide, coarse powder formation becomes easy to inhibit from occurring.

Although reasons for this phenomenon are uncertain, they are supposed to consist e.g. in points that 1) in removing the solvent from the dispersion of silica particles, because supercritical carbon dioxide has the property of lacking in action of surface tension, the solvent can be removed without attended by agglomeration among particles caused by liquid bridge force at the time of solvent removal, and 2) because of a supercritical carbon dioxide's feature that the supercritical carbon dioxide is carbon dioxide which is in a state of being left under a temperature and a pressure higher than its critical points and has both diffusibility of gas and solubility of liquid, the supercritical carbon dioxide comes into contact with the solvent at high efficiency and the solvent is dissolved therein at a relatively low temperature (e.g. 250° C. or lower), the removal of the supercritical carbon dioxide in which the solvent is dissolved allows removal of the solvent in the dispersion of silica particles without forming coarse powder such as secondary agglomerates through the condensation of silanol groups.

Herein, the solvent removing process and the surface treating process may be carried out independently, but it is preferred that these processes be carried out successively (in other words, each process be performed without being opened to the atmospheric pressure). By carrying out these processes successively, the occasion for moisture to adsorb to the silica particles after the solvent removing process is eliminated, and hence the surface treating process can be carried out in a state that excessive adsorption of moisture to the silica particles is inhibited. Thus, it becomes possible to avoid the necessities e.g. for using a siloxane compound in a large amount and carrying out the solvent removing process and the surface treating process at a high temperature under excessive heating. As a result, formation of coarse powder tends to be inhibited with higher efficiency.

The method of producing specific silica particles will now be described in detail on a process-by-process basis.

Incidentally, the method of producing specific silica particles should not be construed as being limited to the method described below, but the production may be done in accordance with 1) an embodiment in which supercritical carbon dioxide is used in the surface treating process alone, 2) an embodiment in which processes are performed independently, and so on.

Each of the processes is described below in detail.

—Dispersion Preparing Process—

In the dispersion preparing process is prepared a silica-particle dispersion containing silica particles and a solvent constituted e.g. of water and alcohol.

To be concrete, in the dispersion preparing process, a dispersion of silica particles is produced e.g. by a wet method (e.g. a sol-gel method), and thereby the dispersion is readied. In particular, it is appropriate that the silica-particle dispersion be produced by a sol-gel method as a wet method, more specifically through the formation of silica particles by induction of reaction (hydrolysis reaction and condensation reaction) of a tetraalkoxysilane in the presence of an alkali catalyst within a water-alcohol mixed solvent.

By the way, the suitable ranges of the average equivalent circle diameter and average circularity of silica particles are the same as described hereinbefore.

In the dispersion preparing process, when silica particles are formed e.g. by a wet method, they are obtained in a state of a dispersion containing silica particles dispersed in a solvent (a silica-particle dispersion).

At the time of transfer to the solvent removing process, it is appropriate that the mass ratio of water to alcohol in the prepared silica-particle dispersion be e.g. from 0.05 to 1.0, preferably from 0.07 to 0.5, far preferably from 0.1 to 0.3.

By adjusting the mass ratio of water to alcohol in the silica-particle dispersion to within such a range, formation of coarse powder from silica particles after undergoing surface treatment is reduced, and it becomes easy to obtain silica particles having satisfactory electric resistance.

When the mass ratio of water to alcohol is lower than 0.05, in the solvent removing process, the condensation of silanol groups on the surfaces of silica particles at the time of removal of the solvent is reduced, and thereby the amount of moisture adsorbed to the surfaces of silica particles after undergoing removal of the solvent is increased, and there are cases where the electric resistance of silica particles after undergoing the surface treatment process becomes too low. On the other hand, when the mass ratio of water to alcohol is higher than 1.0, in the solvent removing process, a lot of water remains near the endpoint of the removal of water in the silica-particle dispersion, and hence agglomeration of silica particles due to liquid bridge force tends to occur, and there are cases where silica particles are present in the form of coarse powder after surface treatment.

Additionally, at the time of transfer to the solvent removing process, it is appropriate that the mass ratio of water to silica particles in the prepared silica-particle dispersion be e.g. from 0.02 to 3, preferably from 0.05 to 1, far preferably from 0.1 to 0.5.

When the mass ratio of water to silica particles in the silica-particle dispersion is adjusted to within the foregoing range, it becomes easy to obtain silica particles which form less coarse powder and have satisfactory electric resistance.

When the mass ratio of water to silica particles in the silica-particle dispersion is lower than 0.02, in the solvent removing process, the condensation of silanol groups on the surfaces of silica particles at the time of removal of the solvent is reduced in the extreme, and thereby the amount of moisture adsorbed to the surfaces of silica particles after undergoing removal of the solvent is increased, and there are cases where the electric resistance of silica particles becomes too low.

On the other hand, when the mass ratio of water to silica particles is higher than 3, in the solvent removing process, a lot of water remains near the endpoint of removal of the water in the silica-particle dispersion, and there are cases where agglomeration of silica particles due to liquid bridge force is apt to occur.

In addition, at the time of transfer to the solvent removing process, it is appropriate in the prepared silica-particle dispersion that the mass ratio of silica particles to the silica-particle dispersion be e.g. from 0.05 to 0.7, preferably from 0.2 to 0.65, far preferably from 0.3 to 0.6.

When the mass ratio of silica particles to the silica-particle dispersion is lower than 0.05, the amount of supercritical carbon dioxide in the silica-particle dispersion becomes large, and there are cases where productivity is lowered.

On the other hand, when the mass ratio of silica particles to the silica-particle dispersion is higher than 0.7, the distance between silica particles in the silica-particle dispersion becomes lessened, and there are cases where formation of coarse powder due to agglomeration and gelation of silica particles is apt to occur.

—Solvent Removing Process—

The solvent removing process is a process of removing the solvent in the silica-particle dispersion e.g. by circulating supercritical carbon dioxide.

In other words, the solvent removing process is a process in which supercritical carbon dioxide is brought into contact with the solvent by being circulated to result in removal of the solvent.

To be concrete, in the solvent removing process, the silica-particle dispersion is charged into e.g. a closed reaction vessel. Thereafter, liquefied carbon dioxide is added to the closed reaction vessel, and the vessel is heated and the pressure inside the vessel is upped with a high-pressure pump to make the carbon dioxide reach a supercritical state. And in step with the admission of supercritical carbon dioxide into the vessel, the supercritical carbon dioxide is discharged from the vessel. In other words, supercritical carbon dioxide is circulated through the closed reaction vessel, in other words the silica-particle dispersion.

Thus, while the solvent (alcohol and water) is dissolved into the supercritical carbon dioxide, the solvent-entrained supercritical carbon dioxide is discharged into the outside of the silica-particle dispersion (the outside of the closed reaction vessel), and thereby the solvent is removed.

Herein, the term supercritical carbon dioxide refers to the carbon dioxide which is in a state of being left under a temperature and a pressure higher than its critical points and has both diffusibility of gas and solubility of liquid.

The temperature condition for the solvent removal, or the temperature of supercritical carbon dioxide, may be e.g. from 31° C. to 350° C., preferably from 60° C. to 300° C., far preferably from 80° C. to 250° C.

When this temperature is below the foregoing range, the solvent is hard to dissolve in the supercritical carbon dioxide, and there are cases where removal of the solvent becomes difficult, and it is supposed that there are cases where formation of coarse powder tends to occur through the liquid bridge force of the solvent and the supercritical carbon dioxide. On the other hand, when such a temperature is beyond the foregoing range, it is supposed that there are cases where coarse powder such as secondary agglomerates tends to form through the condensation of silanol groups on the surfaces of silica particles.

The pressure condition for removal of the solvent, or the pressure on supercritical carbon dioxide, may be e.g. from 7.38 MPa to 40 MPa, preferably from 10 MPa to 35 MPa, far preferably from 15 MPa to 25 MPa.

When this pressure is below the foregoing range, there is a tendency for the solvent to become difficult to dissolve in the supercritical carbon dioxide, and on the other hand, when such a pressure is beyond the foregoing range, there is a tendency for the equipment cost to become expensive.

The amount of supercritical carbon dioxide admitted into and discharged from the closed reaction vessel may be e.g. from 15.4 L/min/$m^3$ to 1,540 L/min/$m^3$, preferably from 77 L/min/$m^3$ to 770 L/min/$m^3$.

When the amount of admission and discharge is smaller than 15.4 L/min/$m^3$, it takes a long time to remove the solvent, and there is a tendency that the productivity is apt to decline.

On the other hand, when the amount of admission and discharge is larger than 1,540 L/min/$m^3$, the supercritical carbon dioxide passes through in a short time, thereby shortening the time to contact with the silica-particle dispersion, and thus causing a tendency that efficient removal of solvent becomes difficult.

—Surface Treating Process—

The surface treating process is a process of treating the surfaces of silica particles with a siloxane compound within the supercritical carbon dioxide successively e.g. to the solvent removing process.

More specifically, in the surface treating process, the surfaces of silica particles are subjected to surface treatment with a siloxane compound within the supercritical carbon dioxide without carrying out opening to the air before transfer e.g. from the solvent removing process.

To be concrete, in the surface treating process, the temperature and pressure inside the closed reaction vessel are adjusted e.g. after stopping the admission and discharge of the supercritical carbon dioxide into and from the closed reaction vessel in the solvent removing process, and in a state that supercritical carbon dioxide is present in the closed reaction vessel, a siloxane compound is charged into the closed reaction vessel in a certain proportion to the silica particles. And in a state that such a situation is maintained, that is, within the supercritical carbon dioxide, the siloxane compound is made to react with silica particles, thereby performing the surface treatment of silica particles.

Herein, it is essential only that, in the surface treating process, reaction of the siloxane compound be carried out within the supercritical carbon dioxide (namely in an atmosphere of supercritical carbon dioxide), and the surface treatment may be performed as the supercritical carbon dioxide is circulated (in other words, as the supercritical carbon dioxide is admitted into and discharged from the closed reaction vessel), or it may be performed without circulation of the supercritical carbon dioxide.

In the surface treating process, the amount of silica particles with respect to the volume of the reaction vessel (namely, the charge-in quantity) may be e.g. from 30 g/L to 600 g/L. preferably from 50 g/L to 500 g/L, far preferably from 80 g/L to 400 g/L.

When this amount is below the foregoing range, the concentration of the siloxane compound in the supercritical carbon dioxide becomes low, and the probability of contact between the siloxane compound and silica surfaces is lowered, and thereby the reaction may become hard to advance. On the other hand, when such an amount is beyond the foregoing range, the concentration of the siloxane compound in the supercritical carbon dioxide becomes high, and the siloxane compound cannot be completely dissolved in the supercritical carbon dioxide to form a poor dispersion; as a result, the silica particles tends to form coarse agglomerates.

The density of supercritical carbon dioxide may be e.g. from 0.10 g/ml to 0.80 g/ml, preferably from 0.10 g/ml to 0.60 g/ml, far preferably from 0.2 g/ml to 0.50 g/ml.

When this density is below the foregoing range, the solubility of siloxane compound in the supercritical carbon dioxide is lowered, and there is a tendency to cause formation of agglomerates. On the other hand, when the density is beyond the foregoing range, the diffusibility into silica pores is lowered, and there are cases where the surface treatment becomes insufficient. It is appropriate that the surface treatment in the foregoing density range be given to the sol-gel silica particles in particular which has a lot of silanol groups.

By the way, the density of supercritical carbon dioxide is adjusted by temperature, pressure and so on.

Examples of the siloxane compound include the same ones as recited hereinbefore. In addition, the preferred range of the siloxane compound density is the same as specified hereinbefore.

When a silicone oil is selected from siloxane compounds and applied, the silicone oil is easy to attach to the surfaces of silica particles in a nearly uniform state, and improvements in flowability, dispersibility and handling of silica particles becomes easy to achieve.

From the viewpoint of making it easy to control the amount of surface attachment of a siloxane compound to silica particles to a range of 0.01 mass % to 5 mass %, the amount of siloxane compound used may be e.g. from 0.05 mass % to 3 mass %, preferably from 0.1 mass % to 2 mass %, far preferably from 0.15 mass % to 1.5 mass %, with respect to the silica particles.

By the way, the siloxane compound, though may be used by itself, may be used in the form of a liquid mixture of itself with a solvent in which the siloxane compound is easy to dissolve. Examples of such a solvent include toluene, methyl ethyl ketone and methyl isobutyl ketone.

In the surface treating process, the surface treatment of silica particles may be carried out by the use of a mixture containing a hydrophobization treatment agent in addition to a siloxane compound.

Examples of a hydrophobization treatment agent include silane-based hydrophobization treatment agents. The silane-based hydrophobization treatment agents are e.g. publicly known silicon compounds having alkyl groups (such as methyl, ethyl, propyl or butyl groups), with examples including silane compounds (such as methyltrimethoxysilane, dimethyldimethoxysilane, trimethylchlorosilane and trimethylmethodysilane) and silazane compounds (such as hexamethyldisilazane and tetramethyldisilazane). These hydrophobization treatment agents may be used alone or as combinations of two or more thereof.

Of these silane-based hydrophobizaion treatment agents, silicon compounds having methyl groups, such as trimethylmethoxysilane and hexamethyldisilazane (HMDS), notably hexamethyldisilazane (HMDS), are preferred over the others.

The amount of silane-based hydrophobization treatment agent used is not particularly limited, and it may be e.g. from 1 mass % to 100 mass %, preferably from 3 mass % to 80 mass %, far preferably from 5 mass % to 50 mass %, with respect to the silica particles.

By the way, the silane-based hydrophobization treatment agent, though may be used by itself, may be used in the form of a liquid mixture of itself with a solvent in which the silane-based hydrophobization treatment agent is easy to dissolve. Examples of such a solvent include toluene, methyl ethyl ketone and methyl isobutyl ketone.

The temperature condition for the surface treatment, or the temperature of supercritical carbon dioxide, may be e.g. from 80° C. to 300° C., preferably from 100° C. to 250° C., far preferably from 120° C. to 200° C.

When this temperature is below the foregoing range, there are cases where the ability of silane compounds to provide surface treatment is lowered. On the other hand, when the temperature is beyond the foregoing range, there are cases where the condensation reaction between silanol groups of silica particles advances to result in occurrence of particle agglomeration. For sol-gel silica particles containing a lot of silanol groups in particular, it is appropriate to receive the surface treatment at a temperature in the foregoing range.

Additionally, it is essential only that the pressure condition for surface treatment, or the pressure on supercritical carbon dioxide, be a pressure satisfying the density range specified hereinbefore, and it is appropriate that the pressure be from 8 MPa to 30 MPa, preferably from 10 MPa to 25 MPa, far preferably from 15 MPa to 20 MPa.

By undergoing the processes explained above, the specific silica particles are produced.

[Other External Additives]

As examples of other external additives, mention may be made of inorganic particles.

(Method for Producing Toner)

Methods for producing toner according to an exemplary embodiment of the invention are illustrated below.

The toner according to an exemplary embodiment of the invention is obtained by producing toner particles and then externally adding external additives to the toner particles.

Toner particles may be produced any of dry production processes (e.g. a kneading-and-pulverizing process) and wet production processes (e.g. an aggregation coalescence process, a suspension polymerization process and a dissolution suspension process). The production process of toner particles are not limited to these processes, but any of well-known processes can also be adopted.

Of those production processes, an aggregation coalescence process is more suitable for production of toner particles.

To be concrete, in the case of producing toner particles e.g. by the use of an aggregation coalescence process, the toner particles are produced through a step of preparing a resin-particle dispersion in which resin particles to form a binder resin are dispersed (a resin-particle dispersion preparing step), a step of forming aggregated particles by making resin particles (together with other particles if required) aggregate within the resin-particle dispersion (a dispersion after undergoing mixing with another particle dispersion if required) (an aggregated-particle forming step) and a step of heating the aggregated-particle dispersion, in which aggregated particles are dispersed, to fuse the aggregated particles and make them coalesce, thereby forming toner particles (a fusion-and-coalescence step).

Details of each step are described below.

By the way, in the following descriptions, the method for producing toner particles having a colorant and a release agent is described, but the colorant and release agent are used therein as required. Of course, additives other than a colorant and a release agent may be incorporated into toner particles.

—Resin-Particle Dispersion Preparing Step—

To begin with, there are prepared not only a resin-particle dispersion in which resin particles to form a binder resin are dispersed but also other dispersions such as a colorant-particle dispersion in which colorant particles are dispersed and a release agent-particle dispersion in which release-agent particles are dispersed.

Herein, the resin-particle dispersion is made e.g. by dispersing resin particles into a dispersion medium with the aid of a surfactant.

An example of the dispersion medium, mention may be made of a water-based medium.

Examples of the water-based medium include water such as distilled water or ion exchange water, and aqueous alcohols. These mediums may be used alone or as combinations of two or more thereof.

Examples of the surfactant include sulfuric acid ester salt-based, sulfonic acid salt-based, phosphoric acid ester-based and soap-based anionic surfactants; amine salt-type and quaternary ammonium salt-type cationic surfactants; and polyethylene glycol-based, alkylphenylethylene oxide adduct-based and polyhydric alcohol-based nonionic surfactants. Of these surfactants, anionic surfactants and cationic surfactants in particular are usable. Nonionic surfactants may be used in combination with anionic or cationic surfactants.

Only one kind of surfactant may be used, or two or more kinds of surfactants may be used in combination.

In preparing the resin-particle dispersion, the method used for dispersing resin particles into a dispersion medium may be a general dispersion method using e.g. a rotary shearing-type homogenizer or a media-contained ball mill, sand mill or dyno mill. Alternatively, depending on the kind of resin particles, the resin particles may be dispersed into a resin-particle dispersion by the use of e.g. a phase-inversion emulsification method.

By the way, the phase-inversion emulsification method is a method of dissolving a resin to be dispersed into a hydrophobic organic solvent in which the resin is soluble, neutralizing the organic continuous phase (O-phase) by adding a base thereto, and then charging a water medium (W-phase) into the organic continuous phase to perform resin shift from W/O to O/W (the so-called phase inversion), thereby developing a discontinuous phase and dispersing the resin into the water medium in a state of particles.

The volume-average particle size of resin particles dispersed in a resin-particle dispersion is e.g. preferably from 0.01 μm to 1 μm, far preferably from 0.08 μm to 0.8 μm, further preferably from 0.1 μm to 0.6 μm.

Incidentally, the volume-average particle size of resin particles is determined by using the particle size distribution obtained through the measurement with a laser diffraction particle size distribution analyzer (e.g. LA-700, made by Horiba Ltd.), drawing cumulative volume distribution from the smaller-size side verses divided particle-size ranges (channels), and defining the particle size corresponding to cumulative 50% with respect to the total particles as a volume-average particle size D50v. In addition, volume-average particle sizes of particles in other dispersions are determined similarly to the above.

The resin-particle content of a resin-particle dispersion is preferably e.g. from 5 mass % to 50 mass %, far preferably from 10 mass % to 40 mass %.

Additionally, a colorant-particle dispersion, a release agent-particle dispersion and so on are also prepared in the same manner as the resin-particle dispersion is prepared. That is to say, matters regarding the volume-average particle size, dispersion medium, dispersion method and content of particles in the resin-particle dispersion ditto for those of colorant particles in the colorant-particle dispersion and those of release agent particles in the release agent-particle dispersion.

—Aggregated-Particle Forming Step—

Next, the resin-particle dispersion is mixed with the colorant-particle dispersion and the release agent-particle dispersion. And in the mixed dispersion, resin particles, colorant particles and release-agent particles are made to hetero-aggregate so as to form aggregated particles containing the resin particles, the colorant particles and the release-agent particles and having sizes close to the intended sizes of toner particles.

More specifically, the mixed dispersion is admixed with e.g. an aggregating agent, and at the same time the pH thereof is adjusted to be acidic (e.g. from 2 to 5). After a dispersion stabilizer is added as required, the resultant mixed dispersion is heated to a temperature lower than the glass transition temperature of the resin particles (specifically, a temperature from −30° C. to −10° C. lower than the grass transition temperature of the resin particles), and thereby the particles dispersed in the mixed dispersion are made to aggregate to result in formation of aggregated particles.

Alternatively, in the aggregated particles forming step, the heating of the mixed dispersion may be carried out after the mixed dispersion is admixed with the aggregating agent under agitation with e.g. a rotary-shearing homogenizer at room temperature (e.g. 25° C.), and then the pH thereof is adjusted to be acidic (e.g. from 2 to 5), and thereto a dispersion stabilizer is added.

Examples of an aggregating agent include a surfactant having the polarity reverse to that of a surfactant used as a dispersant added to the mixed dispersion, an inorganic metal salt and a di- or higher-valent metal complex. When a metal complex in particular is used as the aggregating agent, the amount of surfactant used is reduced and electrification characteristics are enhanced.

An additive which forms a complex or analogous bonding with the metal ion of an aggregating agent may also be used as required. As this additive, a chelating agent is suitably used.

Examples of the inorganic metal salt include metal salts, such as calcium chloride, calcium nitrate, barium chloride, magnesium chloride, zinc chloride, aluminum chloride and aluminum sulfate, and inorganic metal salt polymers, such as polyaluminum chloride, polyaluminum hydroxide and calcium polysulfide.

As the chelating agent, a water-soluble chelating agent may be used. Examples of the chelating agent include oxycarboxylic acids, such as tartaric acid, citric acid and gluconic acid, iminodiacid (IDA), nitrilotriacetic acid (NTA) and etheylenediaminetetraacetic acid (EDTA).

The amount of chelating agent added is e.g. preferably from 0.01 to 5.0 parts by mass, far preferably from 0.1 to 3 parts by mass, with respect to 100 parts by mass of resin particles.

—Fusion-and-Coalescence Step—

Next, by heating the aggregated-particle dispersion, in which aggregated particles are dispersed, to a temperature equal to or higher than the glass transition temperature of the resin particles (e.g. a temperature not lower than the temperature 10° C. to 30° C. higher than the glass transition temperature of the resin particles), the aggregated particles are fused and coalesce to form toner particles.

Toner particles are obtained by going through the foregoing steps.

Alternatively, toner particles may be produced by going through a step of preparing an aggregated-particle dispersion in which aggregated particles are dispersed, a step of further mixing the aggregated-particle dispersion with a resin-particle dispersion in which resin particles are dispersed, thereby further aggregating the resin particles so as to adhere to the surface of the aggregated particles and forming secondary aggregated particles, and a step of heating a secondary aggregated-particle dispersion in which the secondary aggregated particles are dispersed, thereby fusing the secondary aggregated particles and making them fuse and coalesce to form toner particles of core/shell structure.

After the fusion-and-coalescence step has completed, the toner particles formed in the dispersion are subjected to a publicly-known washing step, a solid-liquid separation step and a drying step, and thereby they are obtained in a dry state.

In the washing step, it is preferred in point of electric chargeability that displacement washing using ion exchanged water be given to the toner particles to a sufficient degree. In addition, though there is no particular restriction as to the solid-liquid separation step, it is preferred in point of productivity that the solid-liquid separation be carried out e.g. by suction filtration or pressure filtration. Further, the drying step also has no particular restriction, but it is preferred in point of productivity that the drying step be carried out e.g. by freeze drying, airflow drying, fluidized drying or vibration-type fluidized drying.

And the toner relating to an exemplary embodiment of the invention is produced e.g. by adding external additives to the toner particles obtained in a dry state and mixing them together. It is appropriate that the mixing be carried out e.g. by means of a V-blender, a Henschel mixer or a Loedige mixer. Further, if necessary, coarse particles of toner may be eliminated e.g. by means of a vibration sieving machine or a wind sieving machine.

<Electrostatic Image Developer>

The electrostatic image developer relating to an exemplary embodiment of the invention is an electrostatic image developer containing at least the toner relating to another exemplary embodiment of the invention.

The electrostatic image developer relating to an exemplary embodiment of the invention may be a one-component developer containing only the toner relating to another exemplary embodiment of the invention, or a two-component developer prepared by mixing the toner concerned with a carrier.

There is no particular restriction on the carrier, and publicly-known carriers are usable herein. Examples of the carrier include a coated carrier which is formed by coating the surface of a core material made up of magnetic powder with a coating resin, a magnetic powder-dispersed carrier formed by dispersing and mixing magnetic powder into a matrix resin, and a resin-impregnated carrier formed by impregnating porous magnetic powder with a resin.

In addition, each of the magnetic powder-dispersed carrier and the resin-impregnated carrier may be a coated carrier formed by coating the core material made up of its constituent particles with a coating resin.

Examples of the magnetic powder include powders of magnetic metals such as iron, nickel and cobalt, and powders of magnetic oxides such as ferrite and magnetite.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymer, styrene-acrylate copolymer, straight silicone resin containing organosiloxane bonds as a constituent element and modified products thereof, fluorocarbon resin, polyester, polycarbonate, phenol resin and epoxy resin.

By the way, other additives including conductive particles may be incorporated into the coating resin and the matrix resin as well.

Examples of the conductive particles include particles of metal such as gold, silver or copper, carbon black particles, titanium oxide particles, zinc oxide particles, tin oxide particles, barium sulfate particles, aluminum borate particles and potassium titanate particles.

As an example of the method for coating the surface of a core material with a coating resin, mention may be made of a method of coating the surface of a core material with a coating layer-forming solution in which a coating resin and, if necessary, various kinds of additives are dissolved in an appropriate solvent. As to the solvent, there is no particular restriction, and the solvent may be chosen in consideration of a coating resin used, coating suitability thereof and so on.

Examples of the resin coating method include a dip method wherein a core material is dipped into a solution for forming a coating layer, a spray method wherein a solution for forming a coating layer is sprayed onto the surface of a core material, a fluidized-bed method wherein a solution for forming a coating layer is sprayed in a situation that a core material is made to float by fluidized air, and a kneader coater method wherein the core material of a carrier and a solution for forming a coating layer are mixed together within a kneader coater and then the solvent is removed.

The mixing ratio (by mass) between the toner and the carrier (toner:carrier) in a two-component developer is preferably from 1:100 to 30:100, far preferably from 3:100 to 20:100.

<Image Forming Apparatus and Image Forming Method>

The image forming apparatus and image forming method relating to exemplary embodiments of the invention are described.

The image forming apparatus relating to an exemplary embodiment of the invention is equipped with an image holding material, an electrification unit for electrifying the surface of the image holding material, an electrostatic image forming unit for forming electrostatic images on the electrified surface of the image holding material, a developing unit for accommodating an electrostatic image developer and developing the electrostatic images formed on the surface of the image holding material in the form of toner images by the use of the electrostatic image developer, a transfer unit for transferring the toner images formed on the surface of the image holding material onto the surface of a recording material, and a fixing unit for fixing the toner images transferred on the surface of the recording material. And to the electrostatic image developer is applied the electrostatic image developer relating to an exemplary embodiment of the invention.

In the image forming apparatus relating to an exemplary embodiment of the invention is carried out the image forming method (the image forming method relating another exemplary embodiment of the invention) having an electrifying process wherein the surface of an image holding material is electrified, an electrostatic image forming process wherein electrostatic images are formed on the surface of the electrified image holding material, a development process wherein the electrostatic images formed on the surface of the electrified image holding material are developed in the form of toner images by the use of the electrostatic image developer relating to an exemplary embodiment of the invention, a transfer process wherein the toner images formed on the image holding material are transferred onto the surface of a recording material, and a fixing process in which the toner images transferred to the surface of the recording material are fixed.

To the image forming apparatus relating to an exemplary embodiment of the invention can be applied a well-known image forming apparatus, such as a direct transfer-mode apparatus wherein the toner images formed on the surface of an image holding material are transferred directly to a recording material, an intermediate transfer-mode apparatus wherein the toner images formed on the surface of an image holding material undergo primary transfer to the surface of an intermediate transfer material and the toner images transferred to the surface of the intermediate transfer material undergo secondary transfer to the surface of a recording material, an apparatus provided with a cleaning unit for cleaning the surface of an image holding material before undergoing electrification, or an apparatus provided with a static eliminating unit wherein the surface of an image holding material after transfer of toner images, and that before electrification, is subjected to static elimination by exposure to light for eliminating static charges.

To the intermediate transfer-mode apparatus is applied a structure having as transfer units e.g. an intermediate transfer material to the surface of which toner images are transferred, a primary transfer unit for performing primary transfer of toner images formed on the surface of an image holding material to the surface of an intermediate transfer material, and a secondary transfer unit for performing secondary transfer of the toner images transferred to the surface of the intermediate transfer material to the surface of a recording material.

By the way, in the image forming apparatus relating to an exemplary embodiment of the invention, the section including a development unit may have e.g. a cartridge structure (a process cartridge) capable of attaching to and detaching from the image forming apparatus. As an example of the process cartridge can be used suitably a process cartridge equipped with a development unit which accommodates the electrostatic image developer relating to another exemplary embodiment of the invention.

An example of the image forming apparatus relating to an exemplary embodiment of the invention is illustrated below, but the invention should not be construed as being limited to this example.

Incidentally, the main section shown in the drawing is explained, while explanations of other sections are omitted.

FIG. 1 is a schematic configuration diagram showing an example of an image forming apparatus relating to an exemplary embodiment of the invention.

The image forming apparatus shown in FIG. 1 is equipped with first to fourth image forming units 10Y, 10M, 10C and 10K of an electrophotographic system which produce image outputs of four colors, yellow (Y), magenta (M), cyan (C) and black (K), based on color-separated image data. These image forming units (also referred simply to as "units" hereafter) 10Y, 10M, 10C and 10K are juxtaposed to one another in a horizontal direction at predetermined intervals. Incidentally, these units 10Y, 10M, 10C and 10B may be a process cartridge attachable to and detachable from the image forming apparatus.

Above the units 10Y, 10M, 10C and 10K in the diagram, an intermediate transfer belt 20 as an intermediate transfer material extends through each of the units. The intermediate transfer belt 20 is provided so as to wind, in the direction from the left to right in the diagram, around a driving roll 22 and a supporting roll 24 which are placed at an established spacing in a state that its inside surface is in contact with these rolls, and configured to run in the direction from the first unit 10Y toward the fourth unit 10K. In addition, a force is applied to the supporting roll 24 in such a direction as to part the supporting roll 24 from the driving roll 22 by means of e.g. a spring (not shown in the diagram), and thereby a tension is given to the intermediate transfer belt 20. Further, on the image holding surface side of the intermediate transfer belt 20, an intermediate transfer material cleaning device 30 is provided opposite to the driving roll 22.

And toners of 4 colors, yellow, magenta, cyan and black, stored in toner cartridges 8Y, 8M, 8C and 8K, respectively, are fed into development devices (development units) 4Y, 4M, 4C and 4K of the units 10Y, 10M, 10C and 10K, respectively.

Because the first to fourth units 10Y, 10M, 10C and 10K are equivalent in structure, the first unit 10Y that is provided on the upstream side of the running direction of the intermediate transfer belt and forms yellow images is described below in a units' behalf. Incidentally, descriptions on the second to fourth units 10M, 10C and 10K are omitted by attaching the reference marks magenta (M), cyan (C) and black (K) as substitutes for the mark yellow (Y) to the portions corresponding to the equivalent portions of the first unit 10Y.

The first unit 10Y has a photoreceptor 1Y which acts as an image holding material. On the periphery of the photoreceptor 1Y are disposed, in the order of mention, an electrification roll 2Y for electrifying the surface of the photoreceptor 1Y to a predetermined electric potential (an example of an electrification unit), an exposure device 3 for forming electrostatic images by exposing the electrified surface to laser light 3Y based on image signals having undergone color separation (an example of an electrostatic image forming unit), a development device 4Y for developing electrostatic images by feeding electrified toner to electrostatic images (an example of a development unit), a primary transfer roll 5Y for transferring the developed toner images onto the intermediate transfer belt 20 (an example of a primary transfer unit) and a photoreceptor cleaning device 6Y having a cleaning blade 6Y-1 for cleaning the toner which remains on the surface of the photoreceptor 1Y after primary transfer (an example of a cleaning unit).

By the way, the primary transfer roll 5Y is disposed on the inside of the intermediate transfer belt 20 and provided opposite to the photoreceptor 1Y. Further, bias power sources (not shown in the diagram) for application of primary transfer bias are connected to primary transfer rolls 5Y, 5M, 5C and 5K, respectively. Each bias power source is controlled by a controlling section not shown in the diagram and varies the transfer bias to be applied to each primary transfer roll.

Operations for forming yellow images in the first unit 10Y are illustrated below.

In advance of the operations, the surface of the photoreceptor 1Y is electrified by the electrification roll 2Y first so as to reach an electric potential of −600 V to −800 V.

The photoreceptor 1Y is formed by laminating a photosensitive layer on a conductive substrate (having e.g. a volume resistivity of $1\times10^{-6}$ Ωcm at 20° C.). This photosensitive layer, though high in resistance (resistance of general resin) under normal conditions, has a property that, when it is exposed to laser light 3Y, the exposed area thereof receives a change in specific resistance. Thus laser light 3Y is output to the electrified surface of the photoreceptor 1Y via the exposure device 3 in accordance with yellow image data transmitted from the control section not shown in the diagram. The laser light 3Y is exposed to the photosensitive layer present at the surface of the photoreceptor 1Y, and thereby the electrostatic images corresponding to a yellow image pattern is formed on the surface of the photoreceptor 1Y.

The electrostatic images are images formed on the surface of the photoreceptor 1Y, and they are the so-called negative latent images formed by draining electric charges on the electrified surface of the photoreceptor 1Y from the exposed portion of the photosensitive layer wherein the specific resistance is lowered by exposure to laser light 3Y, while by retaining electric charges on the portion of the photoreceptor whereto no exposure to laser light 3Y has been given.

Accompanying the travel of the photoreceptor 1Y, the electrostatic images formed on the photoreceptor 1Y are moved around to a predetermined development position. At this position, the electrostatic images on the photoreceptor 1Y are converted to visualized images (developed images) as toner images by means of the development unit 4Y.

In the interior of the development device 4Y, an electrostatic image developer containing e.g. at least a yellow toner and a carrier is accommodated. The yellow toner receives triboelectrification by agitation within the development device 4Y, thereby gaining electric charge with the same polarity (negative polarity) as that of the electric charge electrified on the photoreceptor 1Y and being held on a developer roll (an example of a developer holding material). And the surface of the photoreceptor 1Y is made to pass through the development device 4Y, and thereby the yellow toner adheres electrostatically to the static-eliminated latent image portion on the surface of the photoreceptor 1Y to result in development of the latent image with the yellow toner. The photoreceptor 1Y bearing the thus formed yellow toner image is made to run continuously at a predetermined speed, and the toner image developed on the photoreceptor 1Y is conveyed to a predetermined primary transfer position.

When the yellow toner image on the photoreceptor 1Y is conveyed to the primary transfer position, a primary transfer bias is applied to the primary transfer roll 5Y, an electrostatic force trending the photoreceptor 1Y to the primary transfer roll 5Y acts on the toner image, and thereby the toner image on the photoreceptor 1Y is transferred onto the intermediate transfer belt 20. A transfer bias applied at this time has polarity (+) opposite to the toner's polarity (−), and in the first unit 10Y, the transfer bias is controlled to e.g. +10 μA by the control section (not shown in the diagram). On the other hand, the toner remaining on the photoreceptor 1Y is removed by means of the photoreceptor cleaning device 6Y and recovered.

By the way, primary transfer biases applied to the primary transfer rolls 5M, 5C and 5K in and after the second unit 10M are also controlled in conformity to the case of the first unit.

The intermediate transfer belt 20 having obtained the yellow toner image by the transfer in the first unit 10Y is conveyed while being made to pass through, in succession, the second to fourth units 10M, 10C and 10K, and thereby toner images of four colors are overlaid one after another to achieve multilayer transfer.

The intermediate transfer belt 20 having undergone multilayer transfer of toner images of four colors by passage through the first to fourth units comes to a secondary transfer section made up of the intermediate transfer belt 20, the supporting belt 24 in contact with the inside surface of the intermediate transfer belt and a secondary transfer roll 26 (an example of the secondary transfer unit) disposed on the image holding surface side of the intermediate transfer belt 20. On the other hand, recording paper P (an example of a recording material) is fed into a clearance formed between mutually contacting secondary transfer roll 26 and intermediate transfer belt 20 with predetermined timing through the medium of a feed mechanism, and a secondary transfer bias is applied to the supporting roll 24. The transfer bias applied at this time has the same polarity (−) as the toners' polarity (−), and the electrostatic force trending the intermediate transfer belt 20 to the recording paper P acts on the toner images, and thereby the toner images on the intermediate transfer belt 20 are transferred onto the recording paper P. Incidentally, the secondary transfer bias at this time is determined according to the resistance in the secondary transfer section which is detected by a resistance detecting unit (not shown in the diagram), and the voltage thereof is controlled.

Thereafter, the recording paper P is fed into a pressed part (a nip part) of a pair of fixing rolls in the fixing device 28 (an example of a fixing unit), and the toner images are fixed to the recording paper P, resulting in formation of fixed images.

As an example of the recording paper P to be used for transfer of toner images, mention may be made of plain paper for use in an electrophotographic copier or printer. In addition to the recording paper P, an OHP sheet and the like may be used as recording materials.

For the purpose of further enhancing smoothness of the image surface after being fixed, it is appropriate that the surface of recording paper P be also smooth. Examples of recording paper used suitably for such a purpose include coated paper prepared by coating the surface of plain paper with a resin and art paper for printing use.

After the fixing of color images is finished, the recording paper P is conveyed toward an ejection section, and a series of operations for forming color images is completed.

<Process Cartridge/Toner Cartridge>

A process cartridge relating to an exemplary embodiment of the invention is illustrated.

The process cartridge relating to an exemplary embodiment of the invention is a process cartridge that accommodates an electrostatic image developer relating to another exemplary embodiment of the invention and is equipped with a development unit, wherein the electrostatic images formed on the image holding material are developed in the form of toner images by the use of an electrostatic image developer, and that attachable to and detachable from the image forming apparatus.

By the way, the process cartridge relating to an embodiment of the invention is not limited to the foregoing structure, but it may have a structure made up of a development device and at least one unit selected as required from other units including e.g. an image holding material, an electrification unit, an electrostatic image forming unit and a transfer unit.

An example of the process cartridge relating to an exemplary embodiment of the invention is illustrated below, but the invention should not be construed as being limited to this example. Herein, the main part shown in the diagram is described, but descriptions on other parts are omitted.

Figure 2:
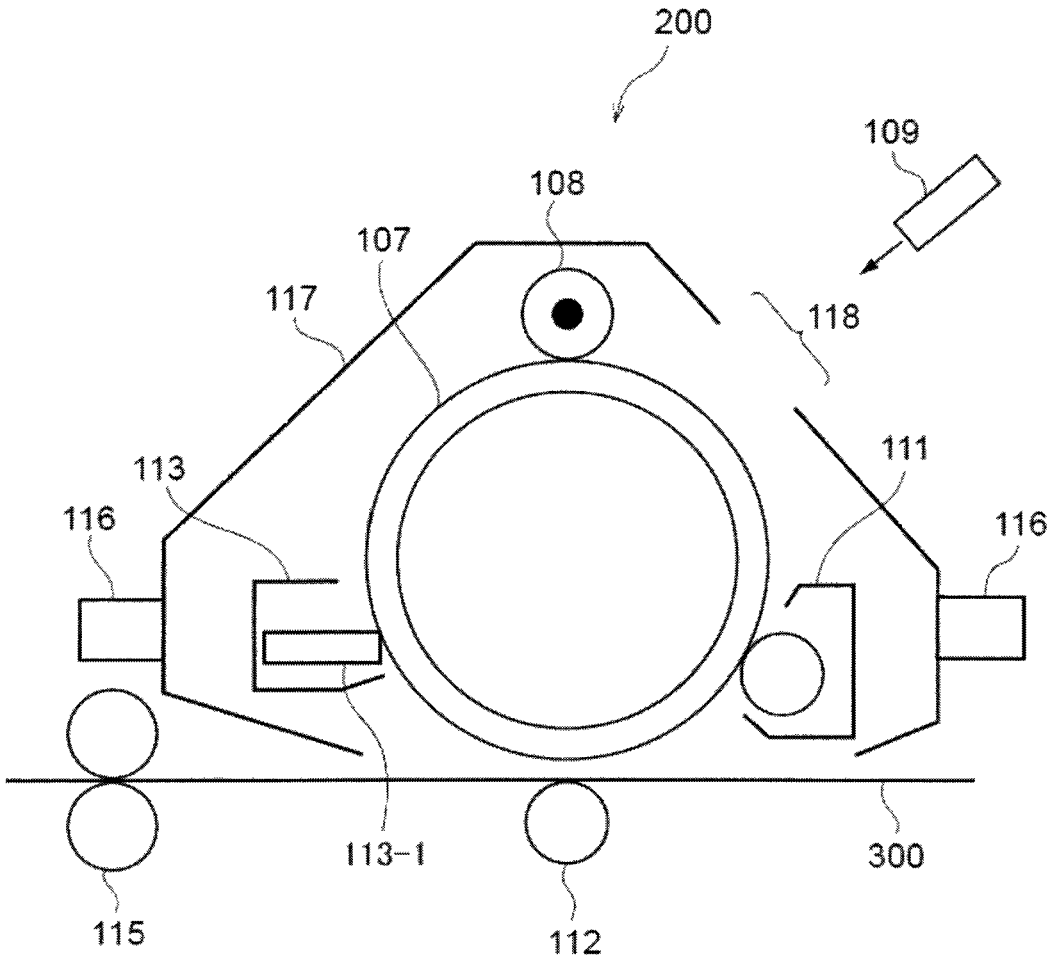
FIG. 2 is a schematic configuration diagram showing an example of a process cartridge relating to an exemplary embodiment of the invention.

FIG. 2 is a schematic configuration diagram showing a process cartridge relating to an exemplary embodiment of the invention.

The process cartridge 200 shown in FIG. 2 is configured to hold a photoreceptor 107 (an example of an image holding material) and devices arranged around the periphery of the photoreceptor 107, including an electrification roll 108 (an example of an electrification unit), a development device 111 (an example of a development unit) and a photoreceptor cleaning device 113 equipped with a cleaning blade 113-1 (an example of a cleaning unit) in an integrally combined form within a package provided with a mounting rail 116 and an aperture 118 for exposure to light, thereby forming them into a cartridge.

Incidentally, in FIG. 2, 109 represents an exposure device (an example of an electrostatic image forming unit), 112 a transfer device (an example of a transfer unit), 115 a fixing device (an example of a fixing unit) and 300 a recording paper (an example of a recording material).

Next, a toner cartridge relating to an exemplary embodiment of the invention is explained.

The toner cartridge relating to an exemplary embodiment of the invention is a cartridge which accommodates a toner relating to another exemplary embodiment of the invention and is attachable to and detachable from the image forming apparatus. The toner cartridge accommodates replenishment toner for feeding into a development unit provided on the inside of the image forming apparatus.

By the way, the image forming apparatus shown in FIG. 1 is an image forming apparatus with a structure allowing attachment/detachment of toner cartridges 8Y, 8M, 8C and 8K, and the development devices 4Y, 4M, 4C and 4K are connected to toner cartridges corresponding to their respective development devices (colors) via the toner feeding tubes not shown in the diagram. Additionally, each of these toner cartridges is replaced when a low toner condition develops therein.

EXAMPLES

Exemplary embodiments of the invention are illustrated below in the concrete by reference to the following examples, but they should not be construed as being limited to these examples. Additionally, in the following descriptions, all pars and percentages are by mass unless otherwise indicated.

[Production of Toner Particles]

(Production of Toner Particles (1))

—Preparation of Polyester Resin-Particle Dispersion—

| | |
|---|---|
| Ethylene glycol [a product of Wako Pure Chemical Industries Ltd.] | 37 parts |
| Neopentyl glycol [a product of Wako Pure Chemical Industries Ltd.] | 65 parts |
| 1,9-Nonanediol [a product of Wako Pure Chemical Industries Ltd.] | 32 parts |
| Terephthalic acid [a product of Wako Pure Chemical Industries Ltd.] | 96 parts |

The above monomers are charged into a flask and heated up to 200° C. for one hour, and after checking on the agitation in the reaction system, 1.2 parts of dibutyltin oxide is charged into the flask. Further, the temperature is raised up to 240° C. from the foregoing temperature over 6 hours as the water formed is distilled away, and dehydration condensation polymerization is continued at 240° C. for additional 4 hours, thereby producing a polyester resin A having an acid value of 9.4 mg KOH/g, a weight-average molecular weight of 13,000 and a glass transition temperature of 62° C.

Then the polyester resin A in a molten state is conveyed to Cavitron CD1010 (a product of Euro Tec) at a rate of 100 parts per minute. A 0.37% diluted ammonia water prepared by diluting the reagent ammonia water with ion exchanged water is charged into an aqueous-medium tank prepared separately, and while being heated at 120° C. by the use of a heat exchanger, it is conveyed at a rate of 0.1 L per minute to the foregoing Cavitron together with the molten polyester resin. The Cavitron is operated under conditions that the rotor's rotating speed is 60 Hz and pressure is 5 kg/cm$^2$, thereby giving a polyester resin-particle dispersion (1) wherein are dispersed resin particles having a volume-average particle size of 160 nm, a solids content of 30%, a glass transition temperature of 62° C. and a weight-average molecular weight Mw of 13,000.

—Preparation of Colorant-Particle Dispersion—

| | |
|---|---|
| Cyan pigment [Pigment Blue 15, a product of Dainichiseika Color & Chemicals Mfg. Co. Ltd.] | 10 parts |
| Anionic surfactant [Neogen SC, a product of DKS Co., Ltd.] | 2 parts |
| Ion exchanged water | 80 parts |

The above ingredients are mixed together, and dispersed for one hour by means of a high-pressure impact disperser, Ultimizer [HJP30006, a product of SUGINO MACHINE LIMITED], thereby preparing a colorant-particle dispersion having a volume-average particle size of 180 nm and a solids content of 20%.

—Preparation of Release Agent-Particle Dispersion—

| | |
|---|---|
| Carnauba wax [RC-160, melting temperature: 84° C., a product of TOAKASEI CO., LTD.] | 50 parts |
| Anionic surfactant [Neogen SC, a product of DKS Co., Ltd.] | 2 parts |
| Ion exchanged water | 200 parts |

The above ingredients are heated to 120° C., mixed and dispersed by means of Ultratalax T50, a product of IKA Co., Ltd., and then subjected to dispersion treatment with a pressure discharge homogenizer, thereby giving a release agent-particle dispersion having a volume-average particle size of 200 nm and a solids content of 20%.

—Production of Toner Particles (1)—

| | |
|---|---|
| Polyester resin-particle dispersion (1) | 200 parts |
| Colorant-particle dispersion | 25 parts |
| Release agent-particle dispersion | 30 parts |
| Polyaluminum chloride | 0.4 parts |
| Ion exchanged water | 100 parts |

The above ingredients are charged into a stainless-steel flask, mixed and dispersed by means of Ultratalax T50, a product of IKA Co., Ltd., and then heated to 48° C. in an oil bath for heating use as agitation is applied to the flask. After the resultant dispersion is kept at 48° C. for 30 minutes, thereto is further added 70 parts of the polyester resin-particle dispersion (1).

Thereafter, the pH of the reaction system is adjusted to 8.0 by the use of an aqueous sodium hydroxide with a 0.5 mol/L concentration, and then the stainless-steel flask is hermetically sealed. The seal on the agitation shaft is sealed against magnetic force, and heating is continued under agitation until the temperature reaches 90° C. And at this temperature the reaction system is kept for 3 hours. After the completion of reaction, cooling is carried out at a temperature-lowering speed of 2° C./min, and further filtration, washing with ion exchange water and solid-liquid separation by Nutsche suction filtration are carried out in succession. The thus obtained solids are dispersed again into 3 L of 30° C. ion exchanged water, and agitated and washed at 300 rpm for 15 minutes. Further, this washing operation is repeated 6 times, and at the time when the filtrate comes to have pH 7.54 and an electric conductivity of 6.5 μS/cm, solid-liquid separation using a filter paper No. 5A according to Nutsche suction filtration is carried out. Subsequently thereto, vacuum drying is continued for 12 hours, and thereby toner particles (1) are produced.

The volume-average particle size D50v and average circularity of the toner particles (1) are 5.8 μm and 0.95, respectively.

(Production of Toner Particles (2))

| | |
|---|---|
| Styrene-butyl acrylate copolymer (copolymerization ratio = 80:20, weight-average molecular weight Mw: $13 \times 10^4$, glass transition temperature Tg: 59° C.) | 88 parts |
| Cyan pigment (C.I. Pigment Blue 15:3) | 6 parts |
| Low-molecular-weight polypropylene (softening temperature: 148° C.) | 6 parts |

The above ingredients are mixed together by means of a Henschel mixer, and kneaded under heating by means of an extruder. After cooling, the kneaded matter is crushed and pulverized, and further the pulverized matter is sized. Thus, toner particles (2) having a volume-average particle size of 6.5 μm and an average circularity of 0.91 are produced.

[Production of External Additive]

(Production of Hydrophobic Silica Particles (A1))

Silica particles (AEROSIL 200, a product of Nippon AEROSIL) in an amount of 100 parts are placed in a mixer, and agitated at 200 rpm in an atmosphere of nitrogen while they are heated to 200° C. Thereinto, hexamethyldisilazene (HMDS) in a total amount of 30 parts is dropped at a dropping speed of 10 parts/hour with respect to 100 parts of powdery silica particles, and after the total HMDS dropping has completed, the reaction is allowed to continue for 2 hours, and then cooled. By the hydrophobization treatment mentioned above are produced hydrophobic silica particles (A1) having an average equivalent circle diameter of 62 nm.

(Production of Hydrophobic Silica Particles (A2))

Hydrophobic silica particles (A2) having an average equivalent circle diameter of 14 nm are produced in the same manner under the same conditions as the hydrophobic silica particles (A1) are produced, except that the silica particles are changed to AEROSIL 300 (a product of Nippon AEROSIL) and the total amount of hexamethyldisilazane (HMDS) dropped is changed to 15 parts.

(Production of Hydrophobic Silica Particles (A3))

Hydrophobic silica particles (A3) having an average equivalent circle diameter of 116 nm are produced in the same manner under the same conditions as the hydrophobic silica particles (A1) are produced, except that the silica particles are changed to AEROSIL OX50 (a product of Nippon AEROSIL).

(Production of Hydrophobic Silica Particles (C1))

Hydrophobic silica particles (C1) having an average equivalent circle diameter of 9 nm are produced in the same manner under the same conditions as the hydrophobic silica particles (A1) are produced, except that the silica particles are changed to AEROSIL 380 (a product of Nippon AEROSIL) and the total amount of hexamethyldisilazane (HMDS) dropped is changed to 8 parts.

(Production of Hydrophobic Silica Particles (C2))

Hydrophobic silica particles (C2) having an average equivalent circle diameter of 136 nm are produced in the same manner under the same conditions as the hydrophobic silica particles (A1) are produced, except that the silica particles are changed to AEROSIL OX50 (a product of Nippon AEROSIL) and the total amount of hexamethyldisilazane (HMDS) dropped is changed to 45 parts.

(Production of Hydrophobic Silica Particles (A4))

Hydrophobic silica particles (A4) having an average equivalent circle diameter of 98 nm are produced in the same manner under the same conditions as the hydrophobic silica particles (A1) are produced, except that the silica particles are changed to AEROSIL OX50 (a product of Nippon AEROSIL) and the total amount of hexamethyldisilazane (HMDS) dropped is changed to 35 parts.

(Production of Hydrophobic Silica Particles (A5))

Hydrophobic silica particles (A5) having an average equivalent circle diameter of 32 nm are produced in the same manner under the same conditions as the hydrophobic silica particles (A1) are produced, except that the silica particles are changed to AEROSIL 300 (a product of Nippon AEROSIL) and the total amount of hexamethyldisilazane (HMDS) dropped is changed to 25 parts.

(Preparation of Silica-Particle Dispersion (1))

Into a 1.5 L of glass reaction vessel equipped with an agitator, a dropping nozzle and a thermometer, 30 parts of methanol and 70 parts of a 10% ammonia water are charged and mixed together, and thereby an alkali catalyst solution is obtained.

Into the alkali catalyst solution under stirring after adjustment of its temperature to 30° C., 185 parts of tetramethoxysilane and 50 parts of 8.0% ammonia water are dropped simultaneously, and thereby a hydrophilic silica-particle dispersion (concentration of solids: 12.0 mass %) is obtained. Herein, the dropping time is set at 30 minutes.

The thus obtained silica-particle dispersion is concentrated to a solids concentration of 40 mass % by means of a rotary filter R-Fine (a product of KOTOBUKI INDUSTRIES CO., LTD.). This concentrated silica-particle dispersion is referred to as Silica-Particle Dispersion (1).

(Preparation of Silica-Particle Dispersions (2) to (8))

Silica-Particle Dispersions (2) to (8) are each prepared in the same manner as in the preparation of Silica-Particle Dispersion (1) are prepared, except that the alkali catalyst solution (the amount of methanol and the amount of 10% ammonia water) and the conditions for forming silica particles (the total dropping amounts of tetramethoxysilane (denoted as TMOS) and 8% ammonia water and the dropping time) are changed to those set forth in Table 1, respectively.

In Table 1 shown below, details about Silica-Particle Dispersions (1) to (8) are summarized.

TABLE 1

| | Alkali catalyst solution | | Conditions for forming silica particles | | |
|---|---|---|---|---|---|
| Silica-particle dispersion | Methanol (parts) | 10% ammonia water (parts) | Total dropping amount of TMOS (parts) | Total dropping amount of 8% ammonia water (parts) | Dropping time |
| (1) | 300 | 70 | 185 | 50 | 30 min. |
| (2) | 300 | 70 | 340 | 92 | 55 min. |
| (3) | 300 | 46 | 40 | 25 | 30 min. |

TABLE 1-continued

| | Alkali catalyst solution | | Conditions for forming silica particles | | |
|---|---|---|---|---|---|
| Silica-particle dispersion | Methanol (parts) | 10% ammonia water (parts) | Total dropping amount of TMOS (parts) | Total dropping amount of 8% ammonia water (parts) | Dropping time |
| (4) | 300 | 70 | 62 | 17 | 10 min. |
| (5) | 300 | 70 | 700 | 200 | 120 min. |
| (6) | 300 | 70 | 500 | 140 | 85 min. |
| (7) | 300 | 70 | 1,000 | 280 | 170 min. |
| (8) | 300 | 70 | 3,000 | 800 | 520 min. |

(Production of Surface-Treated Silica Particles (S1)

Surface treatment using a siloxane compound in an atmosphere of supercritical carbon dioxide is given to the silica particles that the silica-particle dispersion (1) contains. Here, the surface treatment is carried out using the apparatus equipped with a carbon dioxide pump, a carbon dioxide cylinder, an entrainer pump, an agitator-equipped autoclave (volume: 500 ml) and a pressure valve.

To begin with, 250 parts of silica-particle dispersion (1) is charged into the agitator-equipped autoclave (volume: 500 ml), and the agitator is rotated at 100 rpm. Thereafter, liquefied carbon dioxide is poured into the autoclave, and the internal pressure of the autoclave is raised with a carbon dioxide pump as the temperature is raised with a heater until the interior of the autoclave reaches a supercritical state of 150° C. and 15 MPa. While the internal pressure of the autoclave is kept at 15 MPa by means of the pressure valve, the supercritical carbon dioxide is put into circulation by means of the carbon dioxide pump, and thereby the methanol and the water are removed from the silica-particle dispersion (1) (solvent-removing process) and silica particles (untreated silica particles) are obtained.

Next, at the time when the circulation amount of supercritical carbon dioxide having been circulated (accumulated amount: measured as the circulation amount of carbon dioxide in a normal state) reaches 900 parts, the circulation of the supercritical carbon dioxide is brought to a stop.

Thereafter, the temperature is maintained at 150° C. with the heater and the pressure at 15 MPa with the carbon dioxide pump, and under a condition that the supercritical state of carbon dioxide is maintained in the interior of the autoclave, a treatment agent solution prepared in advance by dissolving 0.3 parts of dimethyl silicone oil with a viscosity of 10,000 cSt (DSO, trade name, KF-96, a product of Shin-Etsu Chemical Co., Ltd.) as a siloxane compound into 20 parts of hexamethyldisilazane (HMDS, a product of YUKI GOSEI KOGYO Co., LTD) as a hydrophobization treatment agent is added to 100 parts of the foregoing silica particles (untreated silica particles) through injection into the autoclave by means of the entrainer pump, and subjected to reaction for 20 minutes at 180° C. with agitation. Thereafter, the supercritical carbon dioxide is put into circulation again, and thereby the surplus treatment agent solution is removed. Then, the agitation is brought to a stop, the pressure valve is opened and thereby the inside pressure of the autoclave is unleashed to atmospheric pressure, and the temperature is cooled to room temperature (25° C.).

In this way, the solvent removing process and the surface treatment with the siloxane compound are performed successively, and thereby surface-treated silica particles (S1) are obtained.

(Production of Surface-Treated Silica Particles (S2) to (S5), (S7) to (S9), and (S12) to (S17))

Surface-treated silica particles (S2) to (S5), (S7) to (S9), and (S12) to (S17) are each produced in the same manner as in the preparation of the surface-treated silica particles (S1) are produced, except that the silica-particle dispersion and the surface treatment conditions (the treatment atmosphere, the siloxane compound (species, viscosity and addition amount) and the hydrophobization treatment agent and the addition amount thereof) are changed to those set forth in Table 2, respectively.

(Production of Surface-Treated Silica Particles (S6))

The same dispersion as the silica-particle dispersion (1) used in the production of the surface-treated silica particles (S1) is used, and in the manner as mentioned below, the surface treatment with a siloxane compound is given to the silica particles in the atmosphere.

An ester adapter and a condenser are attached to the same reaction vessel as used in producing the silica-particle dispersion (1), and the silica-particle dispersion (1) is heated to a temperature of 60° C. to 70° C. to remove methanol therefrom. At this time, the resulting dispersion is admixed with water, and further heated to 70° C. to 90° C. to remove methanol therefrom. Thus an aqueous dispersion of silica particles is obtained. To 100 parts of silica solid in this aqueous dispersion, 3 parts of methyltrimethoxysilane (MTMS, a product of Shin-Etsu Chemical Co., Ltd.) is added at room temperature (25° C.), and subjected to reaction for 2 hours, thereby performing treatment for the surfaces of the silica particles. This dispersion having undergo surface treatment is admixed with methyl isobutyl ketone, and heated to a temperature of 80° C. to 110° C. to remove methanol water therefrom. To 100 parts of silica solid in the thus obtained dispersion, 80 parts of hexamethyldisilazane (HMDS, a product of YUKI GOSEI KOGYO CO., LTD.) and 1.0 parts of dimethyl silicone oil with a viscosity of 10,000 cSt (DSO, trade name, KF-96, a product of Shin-Etsu Chemical Co., Ltd.) as a siloxane compound are added at room temperature (25° C.), subjected to reaction at 120° C. for 3 hours, cooled and then dried by spray drying. Thus, surface-treated silica particles (S6) are obtained.

(Production of Surface-Treated Silica Particles (S10))

Surface-treated silica particles (S10) are produced in the same manner as the surface-treated silica particles (S1) are produced, except that fumed silica OX50 (AEROSIL OX50, a product of Nippon AEROSIL) is used in place of the silica-particle dispersion (1). More specifically, 100 parts of OX50 is charged into the same agitator-equipped autoclave as used in producing the surface-treated silica particles (S1) and the agitator is rotated at 100 rpm. Thereafter, liquefied carbon dioxide is injected into the autoclave, and the internal pressure of the autoclave is raised with a carbon dioxide pump as the temperature is raised with a heater until the interior of the autoclave reaches a supercritical state of 180° C. and 15 MPa. While the internal pressure of the autoclave is kept at 15 MPa by means of the pressure valve, a treatment agent solution prepared in advance by dissolving 0.3 parts of dimethyl silicone oil with a viscosity of 10,000 cSt (DSO, trade name, KF-96, a product of Shin-Etsu Chemical Co., Ltd.) as a siloxane compound into 20 parts of hexamethyldisilazane (HMDS, a product of YUKI GOSEI KOGYO CO., LTD.) as a hydrophobization treatment agent is injected into the autoclave by means of the entrainer pump, and subjected to reaction for 20 minutes at 180° C. with agitation, and then the supercritical carbon dioxide is put into circulation, and thereby the surplus treatment agent solution is removed. Thus surface-treated silica particles (S10) is obtained.

(Production of Surface-Treated Silica Particles (S11))

Surface-treated silica particles (S11) are produced in the same manner as the surface-treated silica particles (S1) are produced, except that fumed silica A50 (AEROSIL A50, a product of Nippon AEROSIL) is used in place of the silica-particle dispersion (1). More specifically, 100 parts of A50 is charged into the same agitator-equipped autoclave as used in producing the surface-treated silica particles (S1) and the agitator is rotated at 100 rpm. Thereafter, liquefied carbon dioxide is injected into the autoclave, and the internal pressure of the autoclave is raised with a carbon dioxide pump as the temperature is raised with a heater until the interior of the autoclave reaches a supercritical state of 180° C. and 15 MPa. While the internal pressure of the autoclave is kept at 15 MPa by means of the pressure valve, a treatment agent solution prepared in advance by dissolving 1.0 parts of dimethyl silicone oil with a viscosity of 10,000 cSt (DSO, trade name, KF-96, a product of Shin-Etsu Chemical Co., Ltd.) as a siloxane compound into 40 parts of hexamethyldisilazane (HMDS, a product of YUKI GOSEI KOGYO CO., LTD.) as a hydrophobization treatment agent is injected into the autoclave by means of the entrainer pump, and subjected to reaction for 20 minutes at 180° C. with agitation, and then the supercritical carbon dioxide is put into circulation, and thereby the surplus treatment agent solution is removed. Thus surface-treated silica particles (S11) is obtained.

(Production of Surface-Treated Silica Particles (SC1))

Surface-treated silica particles (SC1) are produced in the same manner as in the preparation of the surface-treated silica particles (S1) are produced, except for the addition of the siloxane compound used for production of the surface-treated silica particles (S1).

(Production of Surface-Treated Silica Particles (SC2) to (SC4))

Surface-treated silica particles (SC2) to (SC4) are each produced in the same manner as the surface-treated silica particles (S1) are produced, except that the silica-particle dispersion and the surface treatment conditions (the treatment atmosphere, the siloxane compound (species, viscosity and addition amount) and the hydrophobization treatment agent and the addition amount thereof) are changed to those set forth in Table 3, respectively.

(Production of Surface-Treated Silica Particles (SC5))

Surface-treated silica particles (SC5) are produced in the same manner as in the preparation of the surface-treated silica particles (S6) are produced, except for addition of the siloxane compound used for production of the surface-treated silica particles (S6).

(Production of Surface-Treated Silica Particles (SC6))

Surface-treated silica particles (SC6) are produced by filtering the silica-particle dispersion (8), drying them at 120° C., placing the dried matter in an electric furnace and burning it at 400° C. for 6 hours, then adding 10 parts of HMDS to 100 parts of silica particles from the silica-particle dispersion (8), and subjecting the resulting particles to spray drying.

(Physical Properties of Surface-Treated Silica Particles)

On the thus produced surface-treated silica particles, measurements of average equivalent circle diameter, average circularity, amount of attachment of the siloxane compound to untreated silica particles (indicated in the wording "amount of surface attachment" in the table), compressive agglomeration degree, particle compression ratio and particle dispersion degree are made in accordance with the methods already described, respectively.

In Table 2 and Table 3, details of surface-treated silica particles are shown in list form. Incidentally, the abbreviated forms in Table 2 and Table 3 stand for the following compounds.

DSO: Dimethyl silicone oil

HMDS: Hexamethyldisilazane

TABLE 2

| Surface-Treated Silica Particles | Silica-Particle Dispersion | Conditions for Surface Treatment: Siloxane compound: Species | Viscosity (cSt) | Amount added (parts) | Treatment atmosphere | Hydrophobization agent/amount added (parts) |
|---|---|---|---|---|---|---|
| (S1) | (1) | DSO | 10,000 | 0.3 | supercritical $CO_2$ | HMDS/20 |
| (S2) | (1) | DSO | 10,000 | 1.0 | supercritical $CO_2$ | HMDS/20 |
| (S3) | (1) | DSO | 5,000 | 0.15 | supercritical $CO_2$ | HMDS/20 |
| (S4) | (1) | DSO | 5,000 | 0.5 | supercritical $CO_2$ | HMDS/20 |
| (S5) | (2) | DSO | 10,000 | 0.2 | supercritical $CO_2$ | HMDS/20 |
| (S6) | (1) | DSO | 10,000 | 1.0 | the air | HMDS/80 |
| (S7) | (3) | DSO | 10,000 | 0.3 | supercritical $CO_2$ | HMDS/20 |
| (S8) | (4) | DSO | 10,000 | 0.3 | supercritical $CO_2$ | HMDS/20 |
| (S9) | (1) | DSO | 50,000 | 1.5 | supercritical $CO_2$ | HMDS/20 |
| (S10) | fumed silica OX50 | DSO | 10,000 | 0.3 | supercritical $CO_2$ | HMDS/20 |
| (S11) | fumed silica A50 | DSO | 10,000 | 1.0 | supercritical $CO_2$ | HMDS/40 |
| (S12) | (3) | DSO | 5,000 | 0.04 | supercritical $CO_2$ | HMDS/20 |
| (S13) | (3) | DSO | 1,000 | 0.5 | supercritical $CO_2$ | HMDS/20 |

TABLE 2-continued

| | | | | | | |
|---|---|---|---|---|---|---|
| (S14) | (3) | DSO | 10,000 | 5.0 | supercritical $CO_2$ | HMDS/20 |
| (S15) | (5) | DSO | 10,000 | 0.5 | supercritical $CO_2$ | HMDS/20 |
| (S16) | (6) | DSO | 10,000 | 0.5 | supercritical $CO_2$ | HMDS/20 |
| (S17) | (7) | DSO | 10,000 | 0.5 | supercritical $CO_2$ | HMDS/20 |

| | Properties of Surface-treated Silica Particles | | | | | |
|---|---|---|---|---|---|---|
| Surface-Treated Silica Particles | Average equivalent circle diameter (μm) | Average circularity | Amount of surface attachment (mass %) | Compressive agglomeration degree (%) | Particle compression ratio | Particle dispersion degree (%) |
| (S1) | 120 | 0.958 | 0.28 | 85 | 0.310 | 98 |
| (S2) | 120 | 0.958 | 0.98 | 92 | 0.280 | 97 |
| (S3) | 120 | 0.958 | 0.12 | 80 | 0.320 | 99 |
| (S4) | 120 | 0.958 | 0.47 | 88 | 0.295 | 98 |
| (S5) | 140 | 0.962 | 0.19 | 81 | 0.360 | 99 |
| (S6) | 120 | 0.958 | 0.50 | 83 | 0.380 | 93 |
| (S7) | 130 | 0.850 | 0.29 | 68 | 0.350 | 92 |
| (S8) | 90 | 0.935 | 0.29 | 94 | 0.390 | 95 |
| (S9) | 120 | 0.958 | 1.25 | 95 | 0.240 | 91 |
| (S10) | 80 | 0.680 | 0.26 | 84 | 0.395 | 92 |
| (S11) | 45 | 0.740 | 0.91 | 88 | 0.396 | 91 |
| (S12) | 130 | 0.850 | 0.02 | 62 | 0.380 | 96 |
| (S13) | 130 | 0.850 | 0.46 | 90 | 0.380 | 92 |
| (S14) | 130 | 0.850 | 4.70 | 95 | 0.360 | 91 |
| (S15) | 185 | 0.971 | 0.43 | 61 | 0.209 | 96 |
| (S16) | 164 | 0.97 | 0.41 | 64 | 0.224 | 97 |
| (S17) | 210 | 0.978 | 0.44 | 60 | 0.205 | 98 |

TABLE 3

| | | Conditions for Surface Treatment | | | | |
|---|---|---|---|---|---|---|
| | | Siloxane compound | | | | Hydro- |
| Surface-Treated Silica Particles | Silica-Particle Dispersion | Species | Viscosity (cSt) | Amount added (parts) | Treatment atmosphere | phobization agent/amount added (parts) |
| (SC1) | (1) | — | — | — | supercritical $CO_2$ | HMDS/20 |
| (SC2) | (1) | DSO | 100 | 3.0 | supercritical $CO_2$ | HMDS/20 |
| (SC3) | (1) | DSO | 1,000 | 8.0 | supercritical $CO_2$ | HMDS/20 |
| (SC4) | (3) | DSO | 3,000 | 10.0 | supercritical $CO_2$ | HMDS/20 |
| (SC5) | (1) | — | — | — | the air | HMDS/80 |
| (SC6) | (8) | — | — | — | the air | HMDS/10 |

| | Properties of Surface-treated Silica Particles | | | | | |
|---|---|---|---|---|---|---|
| Surface-Treated Silica Particles | Average equivalent circle diameter (μm) | Average circularity | Amount of surface attachment (mass %) | Compressive agglomeration degree (%) | Particle compression ratio | Particle dispersion degree (%) |
| (SC1) | 120 | 0.958 | — | 55 | 0.415 | 99 |
| (SC2) | 120 | 0.958 | 2.5 | 98 | 0.450 | 75 |
| (SC3) | 120 | 0.958 | 7.0 | 99 | 0.360 | 83 |
| (SC4) | 130 | 0.850 | 8.5 | 99 | 0.380 | 85 |
| (SC5) | 120 | 0.958 | — | 62 | 0.425 | 98 |
| (SC6) | 300 | 0.980 | 0.22 | 60 | 0.197 | 93 |

Examples 1 to 22 and Comparative Examples 1 to 8

In each of Examples and Comparative Examples, toner is prepared by adding appropriate hydrophobic silica particles shown in Table 4 and appropriate surface-treated silica particles shown in Table 4 in their respective amounts by parts shown in Table 4 to 100 parts of appropriate toner particles shown in Table 4 and mixing these three types of particles by using a Henschel mixer for 3 minutes at 2,000 rpm.

And each toner thus obtained and a carrier in the ratio 5:95 by mass are charged into a V-blender and agitated for 20 minutes, thereby giving each developer.

The carrier used herein is produced as follows.

| | |
|---|---|
| Ferrite particles (volume-average particle size: 50 μm) | 100 parts |
| Toluene | 14 parts |
| Styrene-methyl methacrylate copolymer (ratio between constitutional units: 90/10, Mw: 80,000) | 2 parts |
| Carbon black (R330, a product of Cabot Corporation) | 0.2 parts |

To begin with, the above ingredients other than ferrite particles are agitated for 10 minutes with a stirrer and made into a coating dispersion. Next, this coating dispersion and ferrite particles are charged into a vacuum deaeration-type kneader, agitated for 30 minutes at 60° C., subjected to deaeration under reduced pressure as the temperature is further raised, and then dried. Thus a carrier is obtained.

[Evaluation]

On the toners and the developers produced in each Example and each Comparative Example, evaluations of flowability and image density retainability are performed. Results obtained are shown in Table 4.

(Flowability of Toner)

The developer produced in each of Examples and Comparative Examples is charged into the developing unit of an image forming apparatus (DocuCentre-III C7600, a product of Fuji Xerox Co., Ltd.), and the toner (toner for replenishment use) produced in each of Examples and Comparative Examples is charged into a toner cartridge. By the use of this image forming apparatus, images with 50% image density are output to 10,000 sheets of A4-size paper in 30° C.-80% RH surroundings. In the course of this operation, the cartridge is dismounted after output to 1,000 sheets, 2,000 sheets and 5,000 sheets, respectively, and the delivered toner weight versus driving time is determined. The flowability of toner is evaluated by the weight of toner delivered for 1 minute on the following criteria. Incidentally, evaluation of image density retainability is not made on toner having flowability rated as D.

A: 200 g or more

B: 150 g to lower than 200 g

C: 100 g to lower than 150 g

D: lower than 100 g (Image Density Retainability)

The developer produced in each of Examples and Comparative Examples is charged into the developing unit of an image forming apparatus (DocuCentre-III C7600, a product of Fuji Xerox Co., Ltd.). By the use of this image forming apparatus, images with 80% image density are output to 20,000 sheets of A4-size paper in 30° C.-80% RH surroundings. In the course of this operation, image density measurements with an image densitometer (X-Rite404A, a product of X-Rite Incorporated) are made on 5 points in the image portion of each of the paper having received 10,000th output, the paper having received 15,000th output and the paper having received 20,000th output, the average value of image densities measured is worked out, and evaluation is made on the following criteria. Incidentally, further evaluations are not made on developers rated as D.

The evaluation criteria are as follows.

A: The average value of image densities is 78 or higher.

B: The average value of image densities is from 72 to lower than 78.

C: The average value of image densities is from 67 to lower than 72.

D: The average value of image densities is lower than 67.

TABLE 4

| | Developer | | | | | Toner Flowability | | | | | |
|---|---|---|---|---|---|---|---|---|---|---|---|
| | | Hydrophobic silica paticles | | Surface-treated silica particles | | After output to | After output to | After output to | Image Density Retainability | | |
| | Toner particles | Species | Amount added (parts by mass) | Species | Amount added (parts by mass) | 1,000 sheets | 2,000 sheets | 5,000 sheets | 10,000th sheet | 15,000th sheet | 20,000th sheet |
| Example 1 | (1) | (A1) | 0.5 | (S1) | 0.8 | A | A | A | A | A | A |
| Example 2 | (1) | (A1) | 0.5 | (S2) | 0.6 | A | A | A | A | A | A |
| Example 3 | (1) | (A1) | 0.5 | (S3) | 0.5 | A | A | A | A | A | A |
| Example 4 | (1) | (A1) | 0.5 | (S4) | 0.5 | A | A | A | A | A | A |
| Example 5 | (1) | (A1) | 0.5 | (S5) | 0.5 | A | A | A | A | A | A |
| Example 6 | (1) | (A1) | 0.5 | (S6) | 0.7 | A | A | B | A | C | C |
| Example 7 | (1) | (A1) | 0.5 | (S7) | 0.7 | A | A | A | A | A | B |
| Example 8 | (1) | (A1) | 0.5 | (S8) | 0.6 | A | A | A | A | B | C |
| Example 9 | (1) | (A1) | 0.5 | (S9) | 0.7 | A | A | A | A | A | B |
| Example 10 | (1) | (A1) | 0.5 | (S10) | 0.5 | A | A | B | A | A | C |
| Example 11 | (1) | (A2) | 0.5 | (S11) | 0.5 | A | A | B | A | A | C |
| Example 12 | (1) | (A1) | 0.5 | (S12) | 0.7 | A | A | A | A | A | B |
| Example 13 | (1) | (A1) | 0.5 | (S13) | 0.7 | A | A | A | A | B | C |
| Example 14 | (1) | (A1) | 0.5 | (S14) | 0.7 | A | A | A | A | A | A |
| Example 15 | (1) | (A1) | 0.5 | (S15) | 0.7 | A | A | B | A | B | C |
| Example 16 | (1) | (A1) | 0.5 | (S16) | 0.7 | A | A | B | A | B | C |
| Example 17 | (1) | (A1) | 0.5 | (S17) | 0.7 | A | A | B | A | B | C |
| Example 18 | (1) | (A2) | 0.3 | (S1) | 0.8 | A | A | B | A | A | C |
| Example 19 | (1) | (A3) | 0.67 | (S5) | 0.5 | A | A | B | A | A | C |
| Example 20 | (1) | (A4) | 0.7 | (S1) | 0.8 | A | A | A | A | A | B |
| Example 21 | (1) | (A5) | 0.5 | (S1) | 0.3 | A | A | A | A | A | C |
| Example 22 | (2) | (A1) | 0.5 | (S1) | 0.8 | A | A | A | A | A | B |
| Compar. Ex. 1 | (1) | (A1) | 0.5 | (SC1) | 0.8 | A | B | C | A | C | D |
| Compar. Ex. 2 | (1) | (A1) | 0.5 | (SC2) | 0.7 | A | B | C | A | C | D |
| Compar. Ex. 3 | (2) | (A1) | 0.7 | (SC3) | 0.7 | A | B | D | — | — | — |
| Compar. Ex. 4 | (2) | (A1) | 0.7 | (SC4) | 0.7 | A | B | D | — | — | — |
| Compar. Ex. 5 | (2) | (A1) | 0.7 | (SC5) | 0.7 | A | B | D | — | — | — |
| Compar. Ex. 6 | (2) | (A1) | 0.7 | (SC6) | 0.7 | B | D | — | — | — | — |
| Compar. Ex. 7 | (2) | (C1) | 0.3 | (S1) | 0.8 | A | C | D | — | — | — |
| Compar. Ex. 8 | (1) | (C2) | 0.8 | (S1) | 0.8 | A | C | D | — | — | — |

As can be seen from the results shown above, toner flowability is higher and degradation in image density is inhibited to a greater extent in Examples than in Comparative Examples.

In particular, it turns out that Examples 1 to 5 and Example 14 utilizing as an external additive the specific silica particles which are from 70% to 95% in compressive agglomeration degree and from 0.28 to 0.36 in particle compression ratio ensure higher toner flowability and greater effect on inhibition of degradation in image density than Examples 6 to 13 and Examples 15 to 17 utilizing other specific silica particles as an external additive.

What is claimed is:

1. An electrostatic image developing toner, comprising:

toner particles, first silica particles having an average equivalent circle diameter of 10 nm to 120 nm and second silica particles having and an average equivalent circle diameter of 40 nm to 200 nm, wherein the second silica particles are silica particles surface-treated with a siloxane compound having a viscosity of 1,000 cSt to 50,000 cSt and an amount of the siloxane compound attached to the surfaces of second silica particles is from 0.01 mass % to 5 mass %.

2. The electrostatic image developing toner as claimed in claim 1, wherein the first silica particles are silica particles surface-treated with oil.

3. The electrostatic image developing toner as claimed in claim 2, wherein the oil is a silicone oil.

4. The electrostatic image developing toner as claimed in claim 1, wherein the first silica particles are silica particles externally added to the toner particles in an amount of 0.5 mass % to 5 mass % with respect to the toner particles.

5. The electrostatic image developing toner as claimed in claim 1, wherein the second silica particles have a particle dispersion degree of 90% to 100%.

6. The electrostatic image developing toner as claimed in claim 1, wherein the siloxane compound is a silicone oil.

7. The electrostatic image developing toner as claimed in claim 1, wherein the toner particles comprise a polyester resin having a glass transition temperature of 50° C. to 80° C.

8. The electrostatic image developing toner as claimed in claim 1, wherein the toner particles comprise a polyester resin having a weight-average molecular weight Mw of 5,000 to 1,000,000.

9. The electrostatic image developing toner as claimed in claim 1, wherein the toner particles comprise a polyester resin having a number-average molecular weight Mn of 2,000 to 100,000.

10. The electrostatic image developing toner as claimed in claim 1, wherein the toner particles comprise a polyester resin having a molecular-weight distribution Mw/Mn of 1.5 to 100.

11. The electrostatic image developing toner as claimed in claim 1, wherein the toner particles comprise a binder resin in a proportion of 40 mass % to 95 mass % with respect to an entire amount of the toner particles.

12. The electrostatic image developing toner as claimed in claim 1, wherein the toner particles comprise a colorant in a proportion of 1 mass % to 30 mass % with respect to an entire amount of the toner particles.

13. The electrostatic image developing toner as claimed in claim 1, wherein the toner particles comprise a release agent in a proportion of 1 mass % to 20 mass % with respect to an entire amount of the toner particles.

14. The electrostatic image developing toner as claimed in claim 13, wherein the release agent has a melting temperature of 50° C. to 110° C.

15. The electrostatic image developing toner as claimed in claim 1, wherein the toner particles has an average circularity of 0.90 to 0.98.

16. An electrostatic image developer, comprising the electrostatic image developing toner as claimed in claim 1 and a carrier.

17. The electrostatic image developer as claimed in claim 16, wherein the carrier is a carrier whose surface is coated with a carbon black-containing resin.

18. A toner cartridge that accommodates the electrostatic image developing toner as claimed in claim 1 and is attachable to and detachable from an image forming apparatus.

* * * * *